US005252994A

United States Patent [19]

Narita et al.

[11] Patent Number: 5,252,994

[45] Date of Patent: Oct. 12, 1993

[54] INK-JET RECORDING HEAD

[75] Inventors: Toshio Narita; Shinri Sakai; Masaru Hoshino; Yoshiko Tatsuzawa, all of Nagano, Japan

[73] Assignee: Seiko Epson Corporation, Tokyo, Japan

[21] Appl. No.: 789,641

[22] Filed: Nov. 8, 1991

[30] Foreign Application Priority Data

| | | | |
|---|---|---|---|
| Nov. 9, 1990 | [JP] | Japan | 2-305076 |
| Mar. 18, 1991 | [JP] | Japan | 3-052086 |
| Aug. 2, 1991 | [JP] | Japan | 3-194061 |

[51] Int. Cl.[5] ..... B41J 2/045

[52] U.S. Cl. ..... 346/140 R

[58] Field of Search ..... 346/140 R; 310/328, 310/333

[56] References Cited

U.S. PATENT DOCUMENTS

| | | | |
|---|---|---|---|
| 3,946,398 | 3/1976 | Kyser et al. | 346/1.1 |
| 4,072,959 | 2/1978 | Elmqvist | 346/140 R |
| 4,842,493 | 6/1989 | Nilsson | 346/140 R X |
| 4,888,598 | 12/1989 | Heinzl et al. | 346/140 R |
| 5,016,028 | 5/1991 | Temple | 346/140 R |
| 5,072,240 | 12/1991 | Miyazawa et al. | 346/140 R |

FOREIGN PATENT DOCUMENTS

| | | |
|---|---|---|
| 0116971 | 8/1984 | European Pat. Off. . |
| 0278590 | 8/1988 | European Pat. Off. . |
| 0372521 | 6/1990 | European Pat. Off. . |
| 3820082 | 12/1988 | Fed. Rep. of Germany . |

*Primary Examiner*—Mark J. Reinhart
*Assistant Examiner*—Alrick Bobb
*Attorney, Agent, or Firm*—Sughrue, Mion, Zinn, Macpeak & Seas

[57] ABSTRACT

An ink-jet recording head, in which two piezoelectric substrates are opposite each other in polarization direction, and grooves are formed across the interface of the two substrates at a predetermined pitch so as to form cavities. One of each of the cavities is opened to the atmosphere and include an orifice adapted for squirting ink drops. The cavities have electrodes formed on their inner surfaces. When a voltage of one polarity is applied to the electrode for the cavity from which ink drops is to be generated whereas a voltage of the other polarity is applied to the electrodes for the two adjacent cavities, the diaphragms separating the three cavities deform in a shear mode towards the cavity from which ink drops is to be generated. As a result, the capacity of the cavity from which ink drops is to be generated decreases to have the ink in the cavity squirt outward from the orifice.

36 Claims, 18 Drawing Sheets

INK-JET RECORDING HEAD

FIELD OF THE INVENTION

The invention relates to an ink-jet recording head with which the ink in an ink cavity is squirted in drops by the kinetic energy of a piezoelectric vibrator to form dots on recording paper.

BACKGROUND OF THE INVENTION

An ink-jet printer that squirts drops of ink to print letters and graphics in a dot-matrix format uses a recording head that causes the pressure in the ink cavity to vary by means of a piezoelectric device which produces mechanical deformation upon application of a drive signal. As typically described in U.S. Pat. No. 3,946,398, part of the pressure compartment in this recording head is formed of a diaphragm, to which a piezoelectric substrate shaped in a thin sheet form is attached.

The ink-jet recording head described in the U.S. Pat. No. '398 is operated in such a way that when a drive signal is applied to the piezoelectric device, the ink cavity contracts, whereupon ink is squirted in drops from the nozzle orifice communicating with the ink cavity to form dots on recording paper. Since the piezoelectric device in sheet form is attached to the diaphragm, the pressure compartment must be made large enough to facilitate the operation of attachment. On the other hand, a plurality of nozzle orifices are spaced at very small intervals in order to improve the print quality. Therefore, the pressure compartment and the nozzles must be connected by fluid passage-ways but this only results in a complicated mechanism.

In order to solve those problems, an improved ink-jet printing head has been proposed in, for example, U.S. Pat. No. 4,072,959, and in this printing head a piezoelectric vibrator is positioned in such a way that its tip faces the orifice of each nozzle, with a dynamic pressure being imparted to ink by displacements of the piezoelectric device so that drops of the ink will be squirted from the nozzles. This proposal has the advantage that the fluid passage-ways connecting the pressure compartment and the nozzles are eliminated to achieve structural simplicity. On the other hand, there is a large acoustic impedance mismatch between the piezoelectric vibrator and ink, so the energy produced by the piezoelectric device is not effectively used in drop generation.

In order to solve this problem, EP-A-278590 proposed an ink-jet recording head in which a plurality of passage-ways are formed in one surface of a piezoelectric substrate in a pattern that matches the dot forming region whereas an electrode is provided on the inner surfaces of each passage-way, so that deformation in a shear mode is produced in the walls of the passage-ways to change the capacities of the grooves.

In this recording head, the ink in passage-ways can be directly compressed, so the passage-ways for communicating the ink cavities with the nozzle orifices are eliminated to achieve structural simplicity. Furthermore, the direct compression of the ink cavities offers the advantage of highly efficient drop generation. On the other hand, "nozzle plates" for forming nozzle orifices that insure a stable jet of ink drops must be fixed with an adhesive to the piezoelectric substrate. Then, the area bonded is directly subjected to the expanding and contracting motions of the piezoelectric substrate and this lowers the strength of bonding between the two members. In addition, it is necessary to apply the adhesive to very small areas but this only increases the complexity of the manufacturing process. As a further problem, a step will be formed unavoidably between a groove and the attached nozzle plate and it is difficult to remove air bubbles that are drawn into the groove from the nozzle orifice due to the advancing and retracting motion of the meniscus formed at the nozzle orifice.

SUMMARY OF THE INVENTION

The present invention has been achieved under these circumstances and has as an object providing a novel ink-jet recording head that can be produced by a simple process without mounting nozzle plates and that is capable of forming dots in a consistent manner.

An ink-jet recording head comprises a plurality of piezoelectric substrates that are polarized in the direction of their thickness and that have grooves space by diaphragms at a predetermined pitch and electrodes that are formed in those grooves in an electrically isolated manner, each of said grooves comprising a portion having a sufficient depth to form an ink reservoir, a portion communicating with one side of the head and having a sufficient depth to provide an orifice that is adapted to squirt ink drops, and a portion having a depth appropriate for receiving an externally supplied ink, said piezoelectric substrates being fixed together into a unitary assembly in such a way that the surfaces of the substrates where those grooves are open are in registry and that the directions of polarization in those substrates are opposite to each other, said recording head further including an ink supply means that is provided on the side opposite to the side where said orifice is to be provided.

DESCRIPTION OF PREFERRED EMBODIMENT OF THE INVENTION

Figure 1:
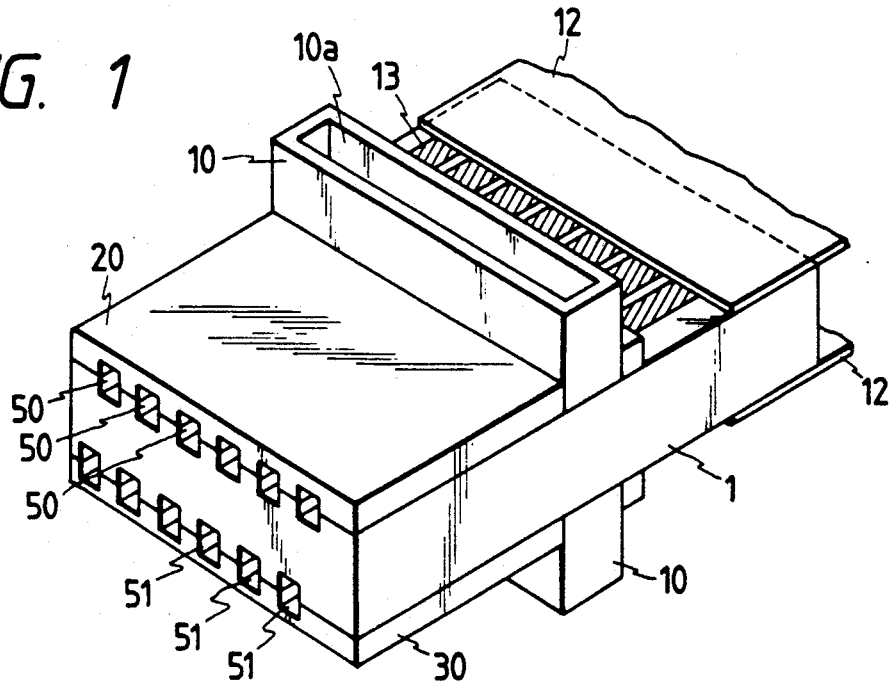
FIG. 1 is a perspective view of an ink-jet recording head according to a first embodiment of the present invention.
Figure 2:
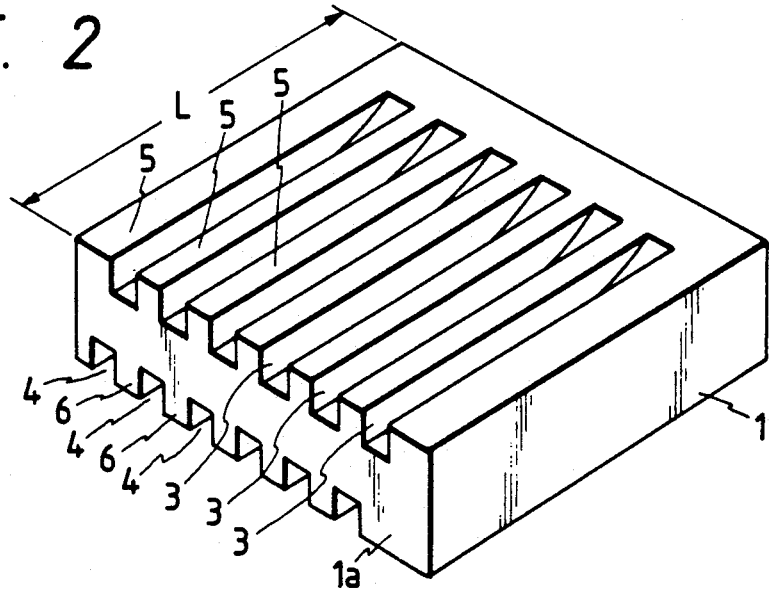
FIG. 2 is a perspective view showing an example of a centrally positioned piezoelectric substrate.

FIG. 1 shows an ink-jet recording head according to a first embodiment of the present invention. Reference numeral 1 represents a central positioned piezoelectric substrate (hereunder referred to as "a center substrate") that is made of lead zirconate or some other material that exhibits a piezoelectric phenomenon. This center substrate has such a thickness that grooves 3 and 4 to be described below can be formed in top and bottom surfaces, respectively, and it is polarized in the direction of its thickness. The top surface of the center substrate has grooves 3 formed therein in such a way that they are spaced by equal distances as shown in FIG. 2; similarly, the bottom surface of the center substrate has grooves 4 formed therein that are also spaced by equal distances. The grooves 3 and 4 serve as fluid passage-ways. The grooves 3 in the top surface are separated by diaphragms 5 that are made of the same piezoelectric material, and the grooves 4 in the bottom surface are separated by diaphragms 6 that are also made of the same piezoelectric material. The grooves 3 are positioned in such a way that they are offset from the grooves 4 by one half of the pitch between adjacent grooves. The grooves 3 and 4 communicate at one end with one side 1*a* of the center substrate 1 in such a way as to form nozzle orifices 50 and 51, whereas the other end of each groove communicates with an ink supply member 10. The surfaces of the rear end of the center substrate 1 are provided with wiring patterns 13 by which electrodes 17 formed continuously on the inner (wall and bottom) surfaces of the grooves 3 and 4 are connected to cables 12 that are connected to a drive circuit (not shown).

Figure 3:
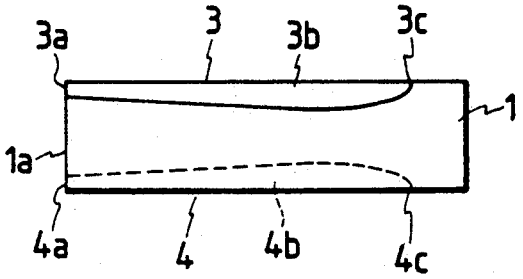
FIG. 3 is a cross-sectional view showing the shape of grooves formed in the center piezoelectric substrate.

As shown in FIG. 3, each front end 3*a* and 4*a* of each groove 3 and 4 that serves as a nozzle orifice is shallow enough to provide an orifice size that is suitable for squirting ink drops; each center portion 3*b* and 4*b* is deep enough to provide a capacity that is capable of accommodating the necessary amount of ink for drop generation; and each rear end of 3*c* and 4*c* of each groove is formed at such a depth that it will have a suitable fluid resistance in cooperation with the inlet port 10*a* of the ink supply member 10.

Figure 4:
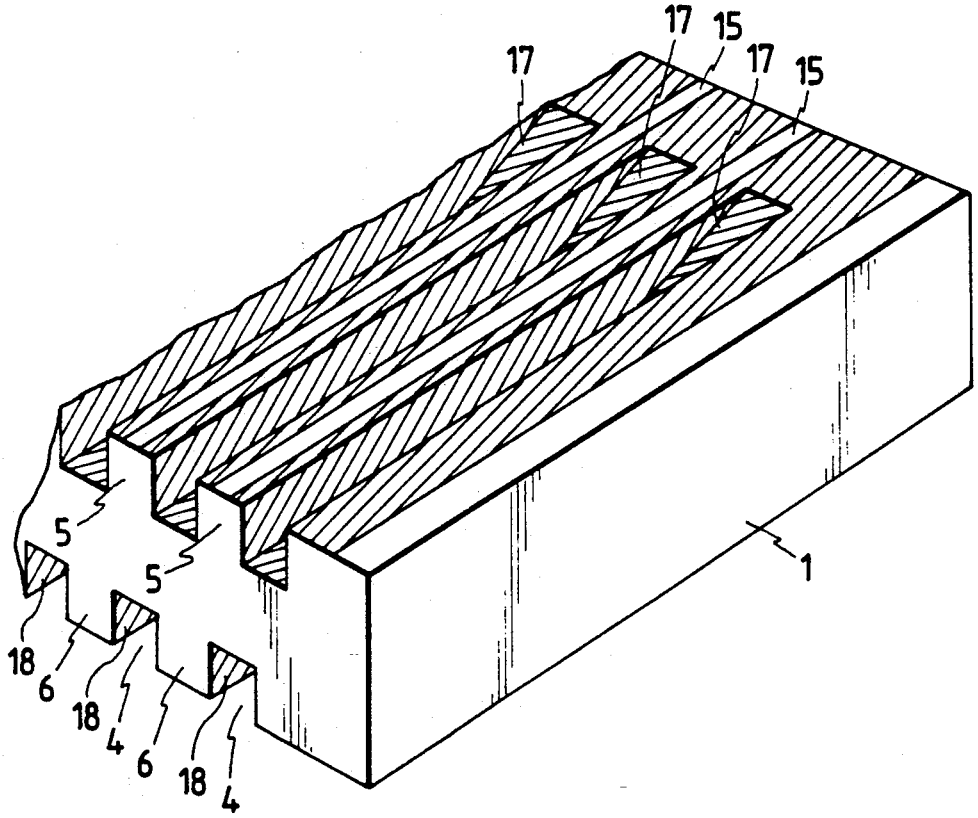
FIG. 4 is a perspective view showing how electrodes are provided on the center piezoelectric substrate.
Figure 5:
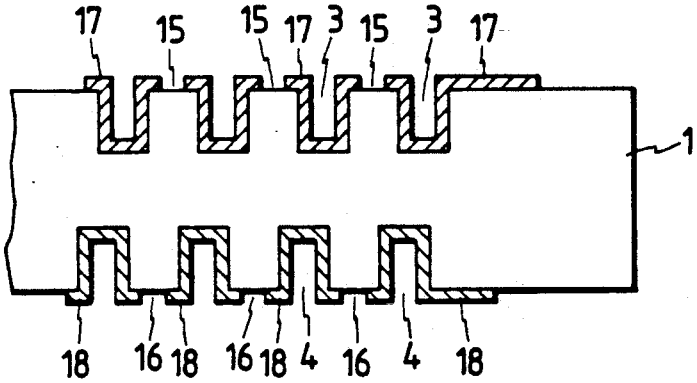
FIG. 5 is a diagram showing the electrode structure of the center piezoelectric substrate.

As shown in FIGS. 4 and 5, the each inner (wall and bottom) surfaces of grooves 3 and 4 and adjacent diaphragms 5 and 6 are covered with a metal layer that is electrically separated by blank portions 15 and 16 to form electrodes 17 and 18 so as to permit the reception of a drive signal from a drive circuit.

Figure 6:
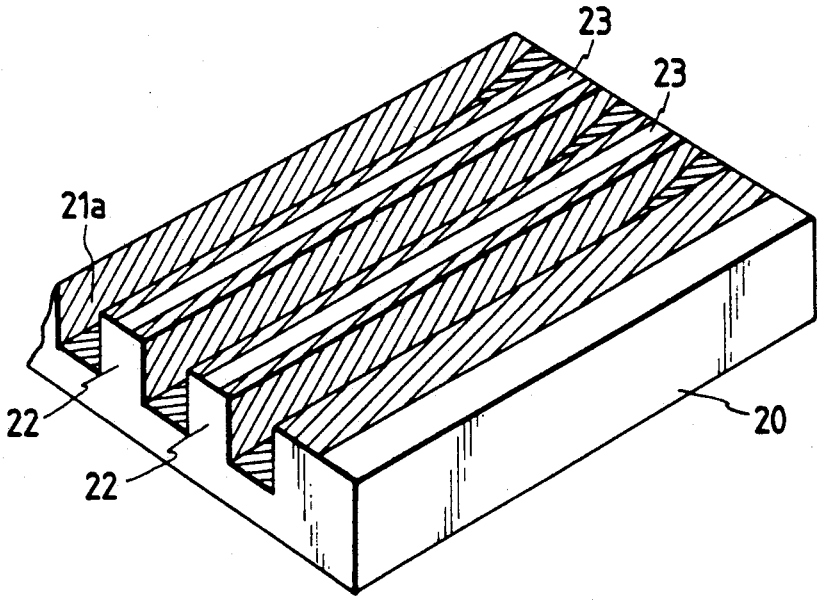
FIG. 6 is a perspective view showing the structure of a piezoelectric substrate to be used in pair with the center piezoelectric substrate.
Figure 7:
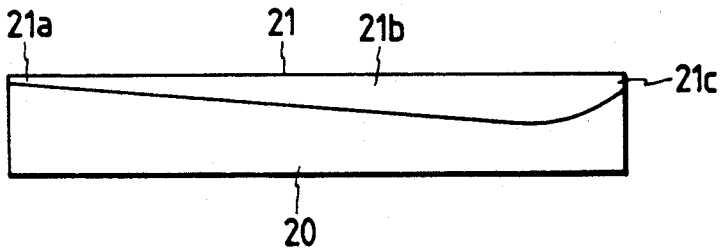
FIG. 7 is diagram showing a sectional structure of a groove formed in the substrate of FIG. 6.
Figure 8:
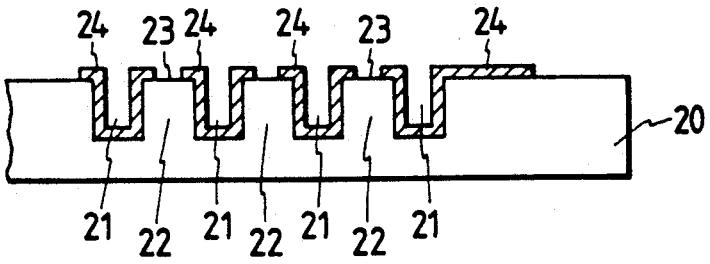
FIG. 8 is a diagram showing the electrode structure of the piezoelectric substrate of FIG. 6.

In FIG. 1, reference numeral 20 is an upper substrate that is made of the same material as the center substrate that exhibits a piezoelectric phenomenon. As shown in FIG. 6, grooves 21 are formed on the surface of the upper substrate so as to face with the grooves 3 formed on the upper surface of the center substrate 1 As shown in FIG. 7, each of the grooves 21 is formed in such a way that the front end 21*a* which provides a nozzle orifice is shallow, that the portion 21*b* providing an ink cavity is deep and that the rear end 21*c* will communicate with the inlet port 10*a* of the ink supply member 10. Each of the grooves 21 are separated by diaphragms 22 and their inner (wall and bottom) surfaces are covered with a metal layer that is electrically separated by blank portions 23 to form electrodes 24. The electrodes 24 are such that when the upper substrate 20 is placed on top of the center substrate 1, they will establish electrical connection with the electrodes 17 on the center substrate 1.

Figure 9:
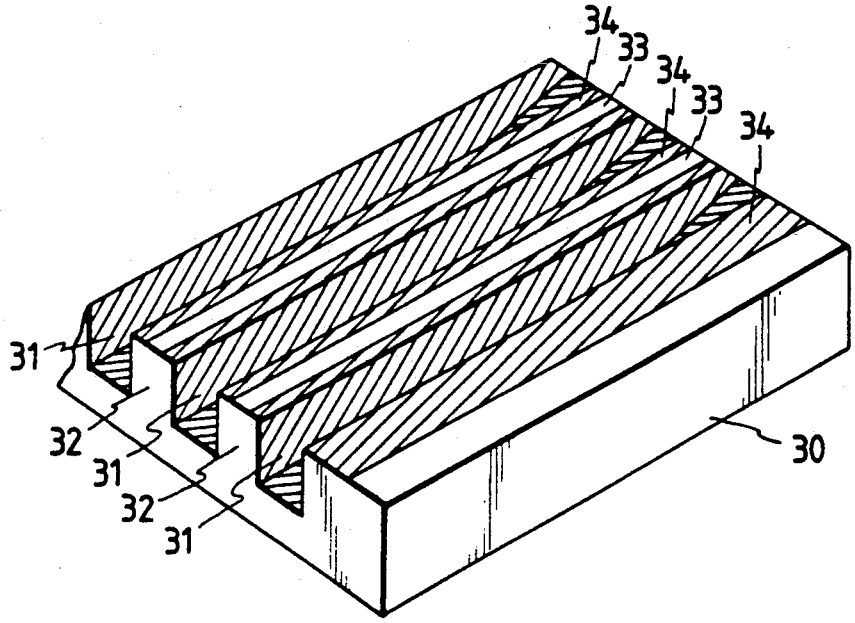
FIG. 9 is a perspective view showing the structure of the other piezoelectric substrate to be used in pair with the center piezoelectric substrate.
Figure 10:
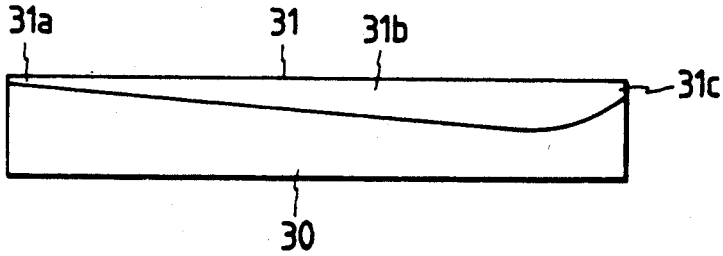
FIG. 10 is a diagram showing sectional structure of a groove formed in the substrate of FIG. 9.
Figure 11:
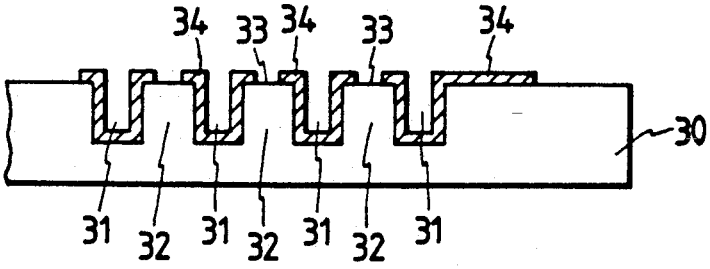
FIG. 11 is a diagram showing the electrode structure of the piezoelectric substrate of FIG. 9.

In FIG. 1, reference numeral 30 is a lower substrate that is made of the same material as the center substrate 1 that exhibits a piezoelectric phenomenon. As shown in FIG. 9, grooves 31 are formed on the surface of the lower substrate so as to face with the grooves 4 formed in the bottom surface of the center substrate 1. As shown in FIG. 10, each of the grooves 31 is formed in such a way that the front end 31*a* which provides a nozzle orifice is shallow, that the portion 31*b* providing an ink cavity is deep and that the rear end 31*c* will communicate with the inlet port 10*a* of the ink supply member 10. The grooves 31 are separated by diaphragms 32 and their inner (wall and bottom) surfaces are covered with a metal layer that is electrically interrupted by blank portions 33 to form electrodes 34. The electrodes 34 are such that when the lower substrate 30 is combined with the center substrate 1, they will establish electrical connection with the electrodes 18 on the center substrate 1.

FIG. 12 illustrates an example of a method of working the center substrate 1, the upper substrate 20 and the lower substrate 30. First, a wedge stand 41 having a predetermined angle, e.g. 2 degrees, is fixed on a horizontal work table 40. Then, a piezoelectric substrate 42 of a predetermined thickness is fixed on the wedge 41. With the workpiece set up in the manner described above, a dicing saw 43 is positioned in such a way that its cutting depth at the front end of the substrate which provides a nozzle orifice will take on a value appropriate for the nozzle orifice, e.g. 30 μm. Thereafter, the dicing saw 43 or the work table 40 is moved relatively by a given distance for cutting the surface of the substrate. As a result, a groove having a predetermined width, e.g. 90 μm, that corresponds to the cutting width of the dicing saw will be formed at the angle specified by the wedge 41. After the cutting of a predetermined length is completed, the table 40 or the dicing saw 43 is further moved in the horizontal direction and the saw is slowly raised up, whereby the shaping of a rear end of the groove is carried out (see FIG. 12A).

When the formation of a single groove is carried out, the work table 40 or the dicing saw 43 is shifted laterally by a predetermined distance, e.g. 170 μm, and the above-described procedure is repeated to form the necessary number of grooves.

Figure 12A:
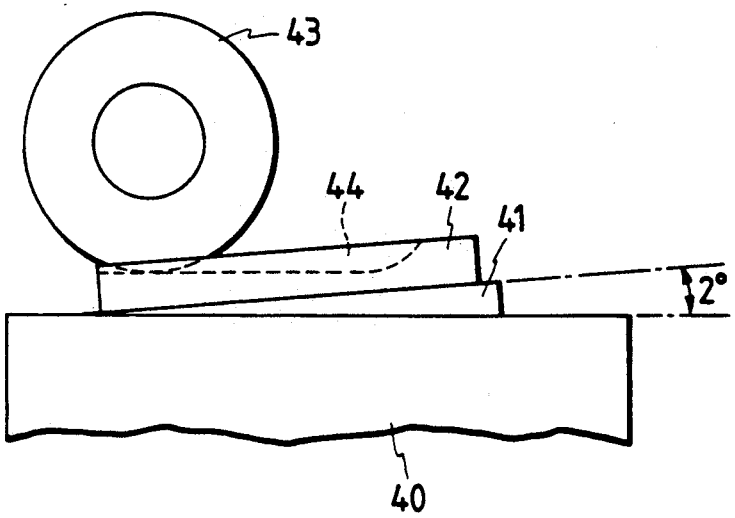
FIGS. 12A to 12D are diagrams showing the step of forming grooves in a piezoelectric substrate and the steps of forming electrodes on the substrate.
Figure 12B:
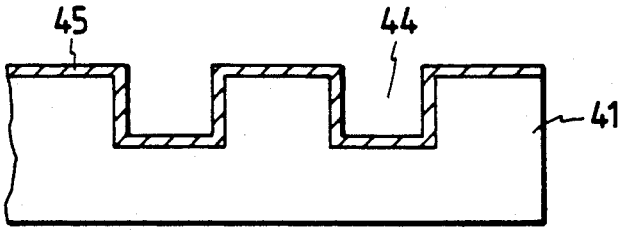
Figure 12C:
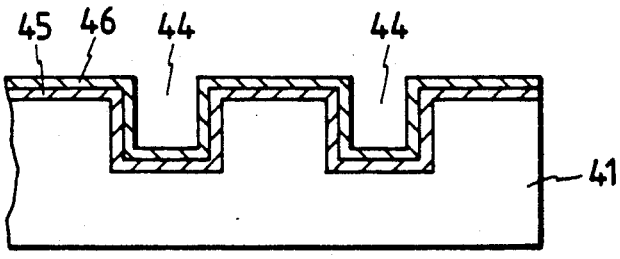

After forming grooves 44 on the surface of the piezoelectric substrates, a nickel layer 45 is formed in a predetermined thickness, e.g. 1 μm on the cut surface of each substrate by a suitable technique such as electroless plating, sputtering or evaporation (see FIG. 12B). The surface of the nickel layer is coated with a corrosion-resistant metal, e.g. gold (Au) layer 46 in a predetermined thickness, e.g. 0.1 μm (see FIG. 12C).

Figure 12D:
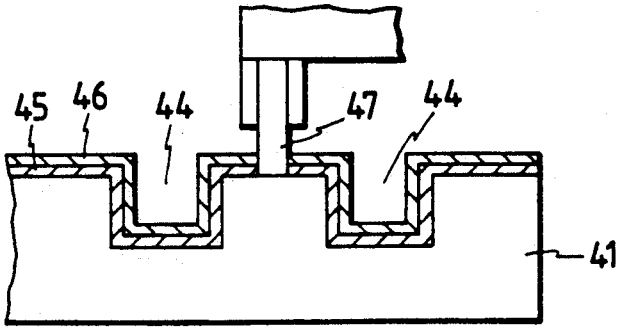

Subsequently, the metal layers 45 and 46 formed on the diaphragms are either cut with a dicing saw 47 or etched by photolithography in a direction parallel to the fluid passageways so as to electrically isolate the plated layers on the individual passage-ways (FIG. 12D).

The substrates thus formed are assembled together in the following manner. The upper substrate 20 and the lower substrate 30 are fixed to the top and bottom surfaces of the center substrate 1 by a suitable means such as an adhesive in such a way that the grooves 21 and 31 will be fit with the grooves 3 and 4, respectively. In addition, an ink supply member 10 that is positioned at the rear end of each of the upper and lower substrates 20 and 30 is fixed to the center substrate in such a way that the ink supply port 10*a* will communicate with the ends 3*a* and 4*a* of the grooves 3 and 4, respectively, in the center substrate 1.

Figure 13:
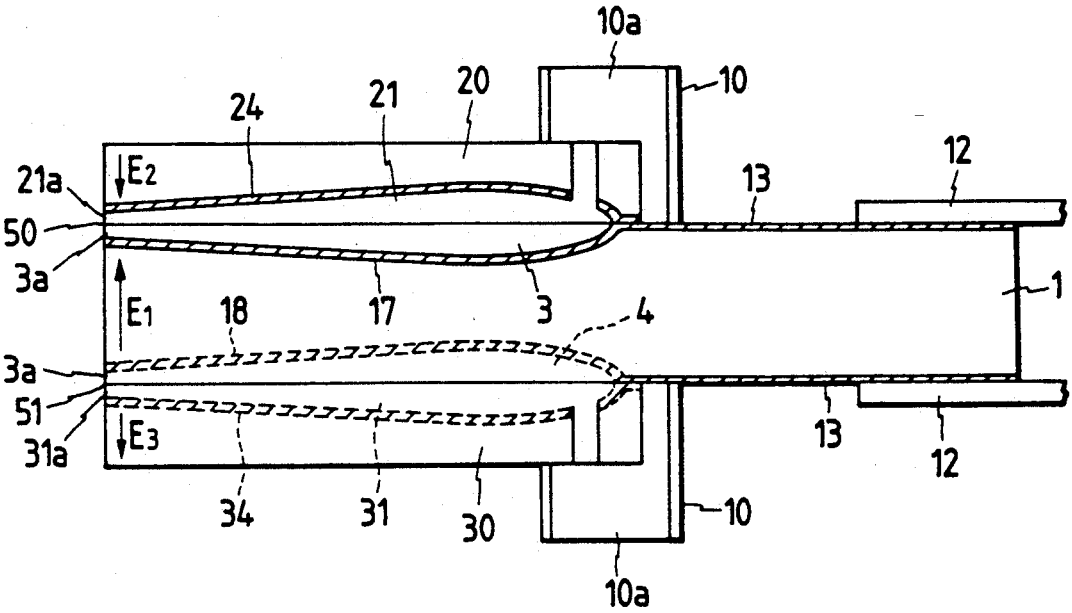
FIG. 13 is a cross-sectional view showing in detail the structure of the ink-jet recording head according to the first embodiment of the present invention.
Figure 14:
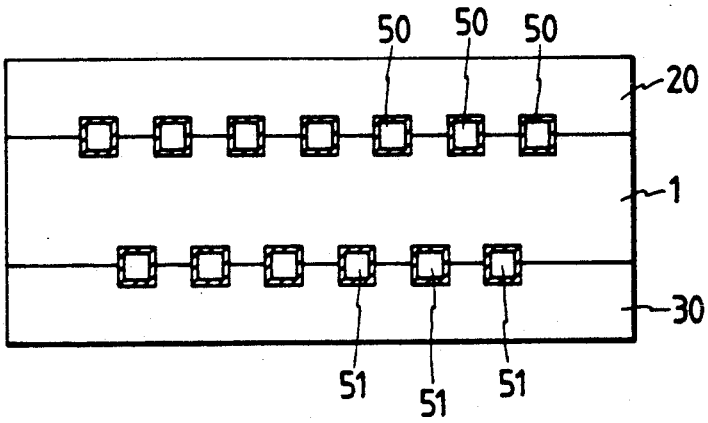
FIG. 14 is a diagram of the recording head of FIG. 13 as seen from the side from which drops of ink are squirted.

As a result, the upper and lower substrates 20 and 30 are positioned and fixed in such a way that the directions of their polarization $E_2$ and $E_3$ that are opposite to the direction of polarization $E_1$ in the center substrate 1 across their interfaces with the latter, as shown in FIG. 13. The grooves formed in the respective substrates 1, 20 and 30 are such that their shallow portions 3*a*/21*a* and 4*a*/31*a* at the front end provide nozzle orifices 50 and 51 as shown in FIG. 14 and, at the same time, those grooves form ink cavities in the central portion that have a cross section shaped like a flattened water drop. The electrodes 24 on the upper substrate 20 and the electrodes 34 on the lower substrate 30 contact to the electrodes 17 and 18 on the opposite surfaces of the center substrate 1, respectively, to establish electrical connection.

Figure 15:
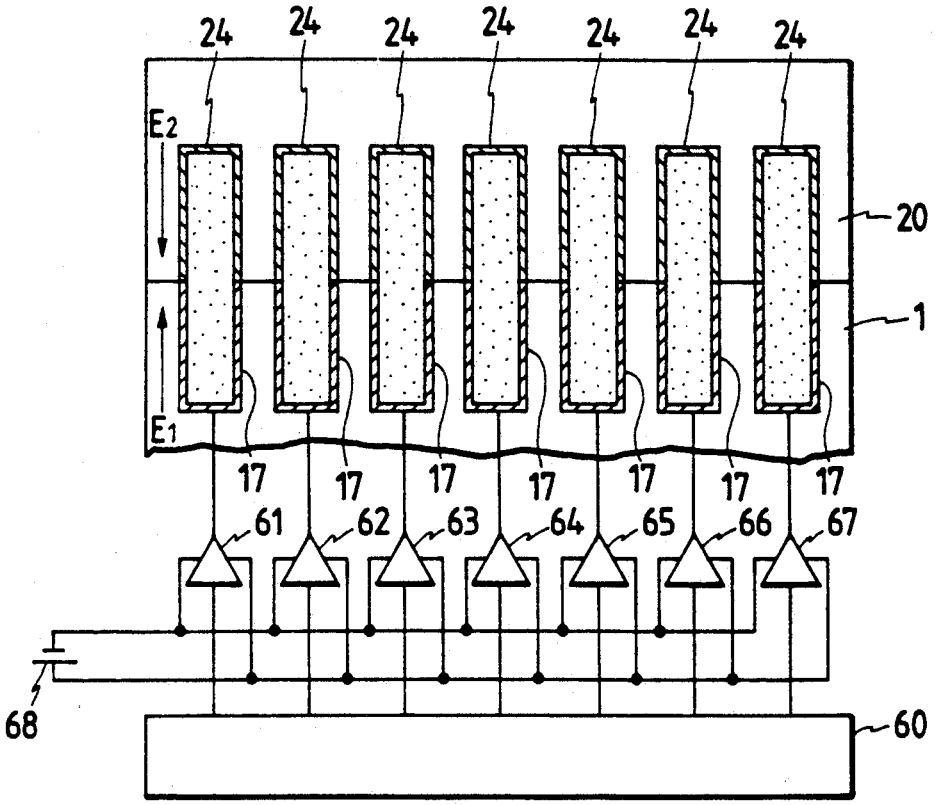
FIG. 15 is a diagram showing a method of driving the ink-jet recording head of the present invention.
Figure 16:
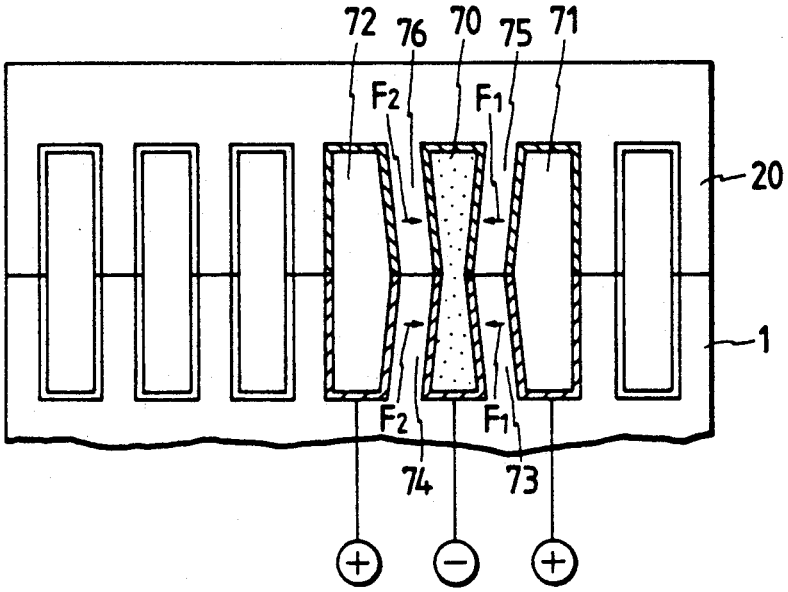
FIG. 16 is a diagram showing how diaphragms are deformed during ejection of ink drops.

FIG. 15 show a method of driving the ink-jet recording head having the construction described above. As shown, the electrodes 24 and 17 formed on the upper substrate 20 and the center substrate 1, respectively, are connected to a drive power supply 68 via three-state drive circuits 61–67 that are to be controlled by a signal from a print data output circuit 60. If a selected ink cavity 70 that corresponds to the position where dots are to be formed is supplied with a voltage of one polarity, e.g. negative, whereas the electrodes for two ink cavities 71 and 72 adjacent to ink cavity 70 are supplied with a voltage of the other polarity, e.g. positive (see FIG. 16), the diaphragms 73 and 74 on the center substrate 1 as well as the diaphragms 75 and 76 on the upper substrate 20 which define the ink cavity 70 in combination with 73 and 74 are subjected to the action of electric fields F1 and F2 that are directed towards the ink cavity 70. As a result, the diaphragms 73, 74, 75 and 76 will deflect in a shear mode towards, the ink cavity 70, which then shrinks in capacity to compress the ink it contains. This causes the ink in the cavity 70 to be squirted in drops from the tapered orifice (FIG. 13). The orifice 50 has a smaller cross-sectional area than the ink cavity 70, so it will act like a nozzle orifice and permits the ink in the cavity to be squirted in drops of an optimal diameter to jet until they reach a recording sheet and form dots on its surface.

When the dot generation ends and no more drive signal is applied, the deformed diaphragms 73–76 will be restored to their initial state. In this process of restoration, the ink cavity will expand, so that additional ink is supplied into the ink cavity 70 through the inlet port 10*a* to condition the head for the next cycle of dot generation.

Figure 17:
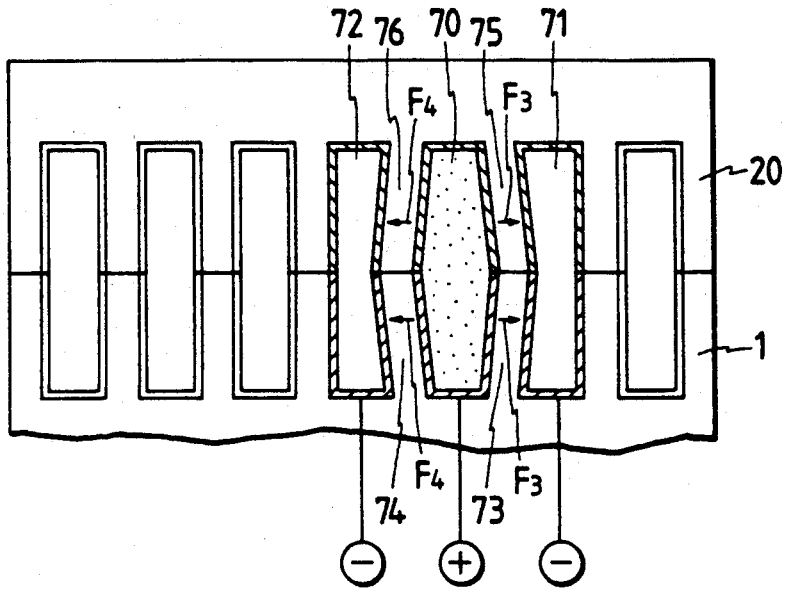
FIG. 17 is a diagram showing another method of driving the ink-jet recording head of the present invention.

In the first embodiment of the present invention, ink is ejected by abruptly deforming the cavity defining diaphragms as ink is flowing into the cavity. Alternatively, electric fields $F_3$ and $F_4$ that will change their strength at small rate may be first applied as shown in FIG. 17 in directions that expand the ink cavities 71 and 72 adjacent the cavity 70, whereupon the diaphragms 75 and 76 on the upper substrate 20 and the diaphragms 73 and 74 on the center substrate 1 are deformed at a relatively slow speed to fill the cavity 70 with ink. Following this preliminary step, the diaphragms 73–76 are abruptly deformed as in FIG. 16 to eject ink drops. That is, the ink cavity 70 is filled with the necessary amount of ink, and the elastic energy stored in the diaphragms 73–76 is effectively used to generate ink drops with high efficiency.

Further, in the first embodiment described above, grooves are formed in both surfaces of the center substrate 1 so as to provide nozzle orifices in two rows. If desired, grooves may be formed in only one surface of the center substrate 1 while other grooves are formed in the corresponding surface of either the upper or lower substrate to provide nozzle orifices in one row. It will be apparent to one skilled in the art that the same result can be achieved by this modified arrangement.

Figure 18A:
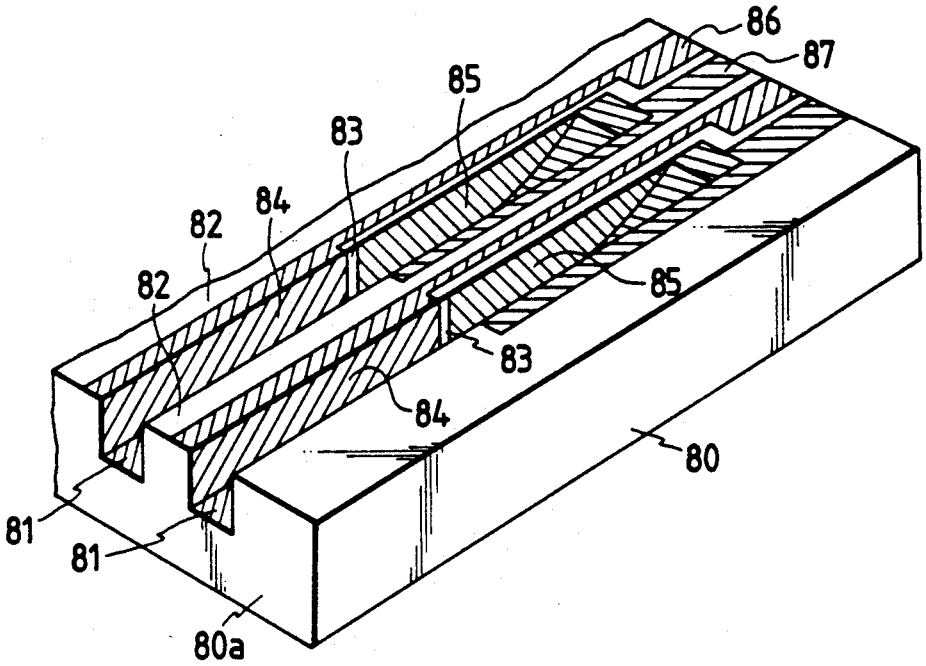
FIGS. 18A and 18B are perspective views showing another example of the electrode structure to be used.
Figure 18B:
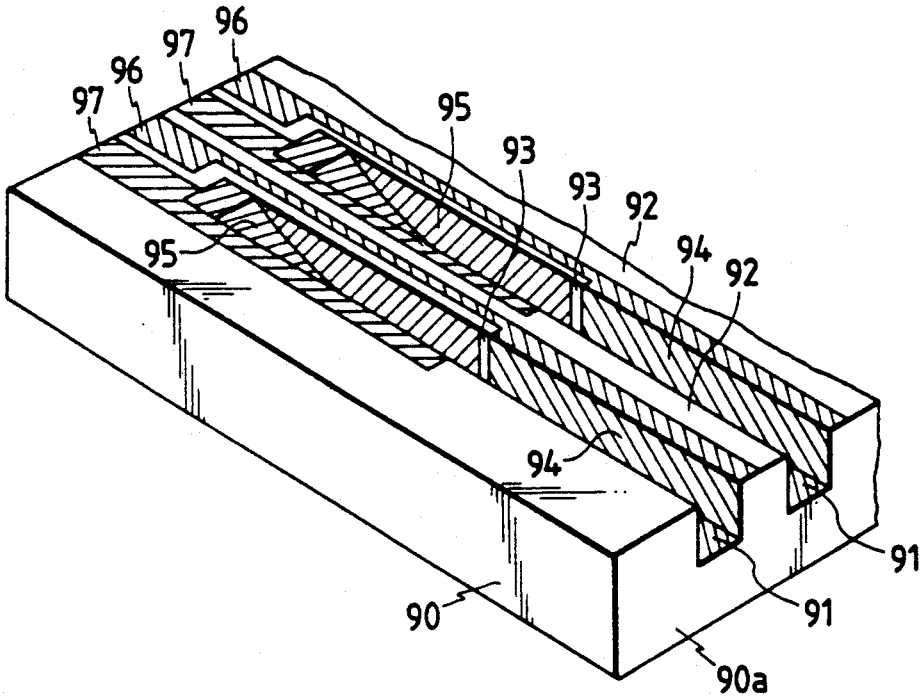

FIGS. 18A and 18B are diagrams showing another example of the structure of piezoelectric substrates to be used in making the ink-jet recording head of the present invention. In FIG. 18, reference numeral 80 is a piezoelectric substrate that is made of lead zirconate or some other material that exhibits a piezoelectric phenomenon. The piezoelectric substrate is polarized in the direction of its thickness and has grooves 81 formed in its surface at equal spacings to provide fluid passage-ways. The grooves 81 are separated by diaphragms 82 that are made of the same piezoelectric material. One end of each groove 82 communicates with one side 80*a* of the substrate 80 so as to form a nozzle orifice whereas the other end communicates with the ink supply port.

As in the embodiment already described above, the grooves 81 are formed in such a way that the front end of each groove which serves as a nozzle orifice is shallow enough to provide an orifice size that is suitable for squirting ink drops, that the center portion is deep enough to provide a capacity that is capable of accommodating the necessary amount of ink for drop generation, and that the rear end is of such a depth that it will have a suitable fluid resistance in cooperation with the inlet port of the ink supply member. Further, the inner (wall and bottom) surfaces of groove 81 are provided with electrodes 84 and 85 each of which is divided longitudinally into two parts by a blank space 83. The electrodes 84 and 85 are so adapted as to be connected to an external circuit by means of conductive patterns 86 and 87.

A substrate 90 which makes a pair with the substrate 80 (see FIG. 18B) is made of the same piezoelectric material and that has grooves 91 and electrodes 94 and 95 formed on its surface in such a way that they are symmetrical with the grooves 81 and electrodes 84 and 85 so as to place with each other. Stated more specifically, grooves 91 are formed in the surface of the substrate 90 at equal spacings to provide fluid a passage-ways and those grooves 91 are separated by diaphragms 92 that are made of the material as the substrate 90. One end of each groove 91 communicates with one side 90*a* of the substrate 90 so as to form a nozzle orifice whereas the other end communicates with the ink supply port. As in the embodiment already described above, the grooves 91 are formed in such a way that the front end of each groove which serves as a nozzle orifice is shallow enough to provide an orifice size that is suitable for squirting ink drops, that the center portion is deep enough to provide a capacity that is capable of accommodating the necessary amount of ink for drop generation, and that the rear end is of such a depth that it will have a suitable fluid resistance in cooperation with the inlet port the ink supply member. Further, the inner (wall and bottom) surfaces of grooves 91 are provided with electrodes 94 and 95 each of which is divided longitudinally into two parts by a blank space 93. The electrodes 94 and 95 are so adapted as to be connected to an external circuit by means of conductive patterns 96 and 97.

When the two piezoelectric substrates 80 and 90 are bonded or otherwise connected, with their cut surfaces facing each other, they will have polarization vectors E4 and E5 acting in opposite directions across the interface while, at the same time, the shallow front portions of the grooves in the substrates combine to provide ink cavities that have tapered nozzle orifices and that resemble flattened water drops in cross section. In addition, the two electrodes 84 and 85 for the grooves 81 in the substrate 90 and the two electrodes 94 and 95 on the substrate 90 contact each other to establish electrical connection, with each ink cavity having an electrode that is divided into two parts in the longitudinal direction.

Figure 19:
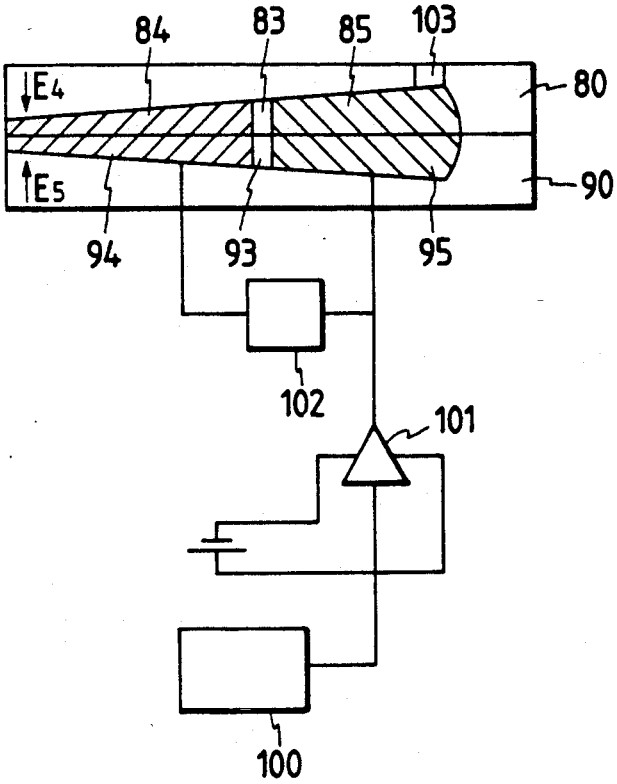
FIG. 19 is an illustration of a method that is suitable for driving a recording head that has the electrode structure shown in FIG. 18.

FIG. 19 illustrates a method for driving the printing head having the construction described above. A print data output circuit 100 supplies a control signal to a three-state drive circuit 101 whose output is supplied directly to the electrodes 85 and 95 closer to an ink supply port 103 where the same output is supplied to the electrode 84 and 94 on the nozzle orifice side via a delay circuit 102 that delays the output by the time necessary for a vibration to propagate from the electrodes 85 and 95 to the electrodes 84 and 94.

In the circuitry shown in FIG. 19, a drive signal is first applied to the electrodes 85 and 95 closer to the ink supply port 103, so that only the regions of electrodes 85 and 95 of the diaphragms 82 and 92 are deformed towards an ink cavity, whereupon the ink in the cavity is compressed to create an elastic wave. When the time set in the delay circuit 102 (e.g. 20 microseconds if the distance between the centers of two electrode segments is 20 mm) has passed, the elastic wave from the electrodes 85 and 95 reaches the electrodes 84 and 94, whereupon the delay circuit 102 outputs a drive signal that is applied to the electrodes 84 and 94. As a result, the regions of the electrodes 84 and 94 of the diaphragms 82 and 92 are deformed to further compress the ink, thereby producing an elastic wave that is superposed on the elastic wave generated by the electrodes 85 and 95. This allows the ink flowing towards the nozzle orifice to be compressed with high efficiency and within a short region, whereby a sharp pressure wave is exerted at the nozzle orifice to have the ink squirted in drops without any tailing.

In the foregoing discussion, each of the electrodes for grooves is divided into two parts in the longitudinal direction but if necessary it may be divided into three or more parts in the longitudinal direction so that a drive signal is applied to the successive electrode segments with a time lag being provided that corresponds to the time required for the pressure wave generated at the ink supply port to reach the respective electrode segments. It will be apparent to one skilled in the art that the same result can be attained by this modified arrangement.

Figure 20A:
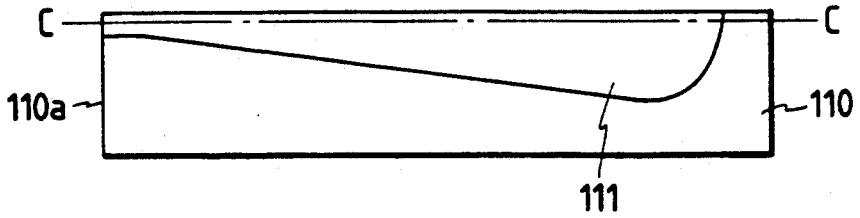
FIG. 20A shows a section of another example of the electrode structure to be used.
Figure 20B:
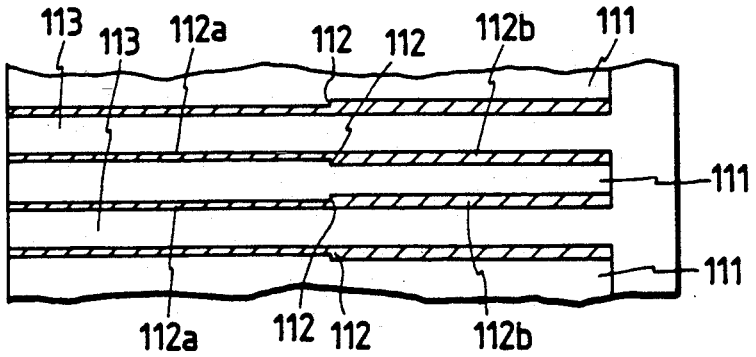
FIG. 20B is a diagram showing the same electrode structure as seen from the side where the grooves are open.

FIGS. 20A and 20B show another example of the electrode structure to be used in the ink-jet recording head of the present invention. Reference numeral 110 is a piezoelectric substrate which, as in the embodiment already described above, has grooves 111 formed in its surface that communicate with one end 110*a* of the substrate to form nozzle orifices. The inner (wall and bottom) surfaces of grooves 111 are provided with electrodes 112 for allowing an electric field to act on diaphragms with which the grooves are separated. Each electrode 112 consists of two regions, one being region 112*a* that is closer to the distal end 110*a* of the substrate where a nozzle orifice opens and the other being region 112*b* that is closer to the ink supply port, and the second region 112*b* is formed to be thicker than the first region 112*a*. Needless to say, such electrodes that vary in thickness in different regions can be easily formed by controlling the time of evaporation or plating.

With the electrode structure described above, the elasticity of diaphragms that are closer to the ink supply port can be enhanced by metals that have a higher elastic modulus than the piezoelectric substrate, so those diaphragms will deform faster than the diaphragms that are closer to the nozzle orifice. At the time when the pressure wave of the ink that has been generated by the deformation of those diaphragms reaches the nozzle orifice, the diaphragms in that region are still in the process of deformation, so the pressure wave propagating from the ink supply port will be further compressed to insure that a pressure wave that is as sharp as is produced in the previous embodiment will act on the nozzle orifice to have the ink squirted in drops without tailings.

Figure 21A:
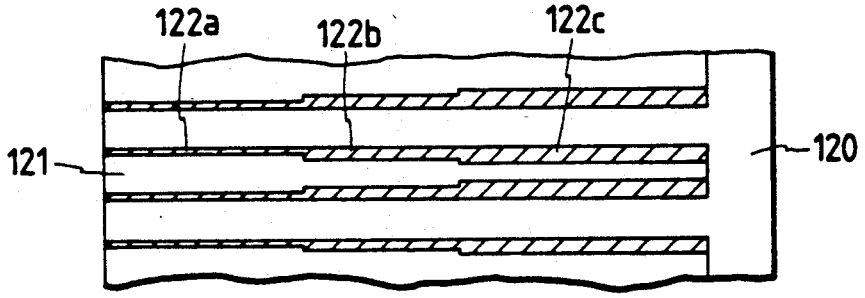
FIGS. 21A and 21B are diagrams showing two other examples of the electrode structure as seen from the side where the grooves are open.
Figure 21B:
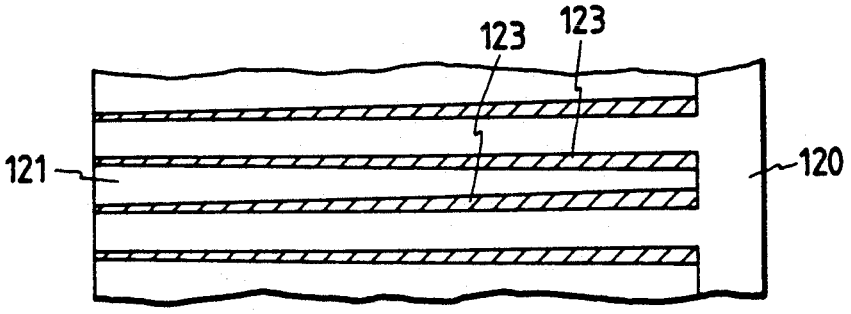

In the case described above, the thickness of the metal layer forming the electrodes is adjusted to vary at two levels along the grooves. Two other examples of the electrode structure are shown in FIGS. 21A and 21B; the electrode 122 shown in FIG. 21A consists of three portions, 122*a*, 122*b* and 122*c*, that are formed in such a way that the thickness increases stepwise in the order written along a groove 121 in a piezoelectric substrate 120; and the electrode 123 shown in FIG. 21B is formed in such a way that is thickness increases monotonically towards the ink supply port. It will be apparent to one skilled in the art that the same result can be attained by those modifications.

Figure 22A:
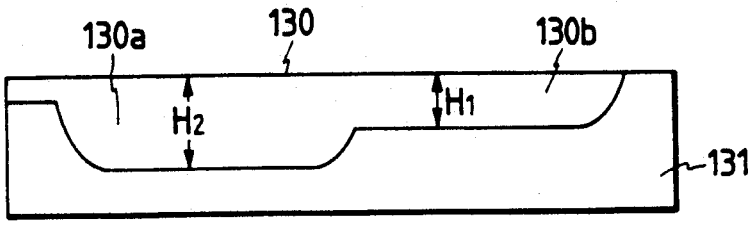
FIG. 22A shows a section of another example of grooves formed in a piezoelectric substrate.
Figure 22B:
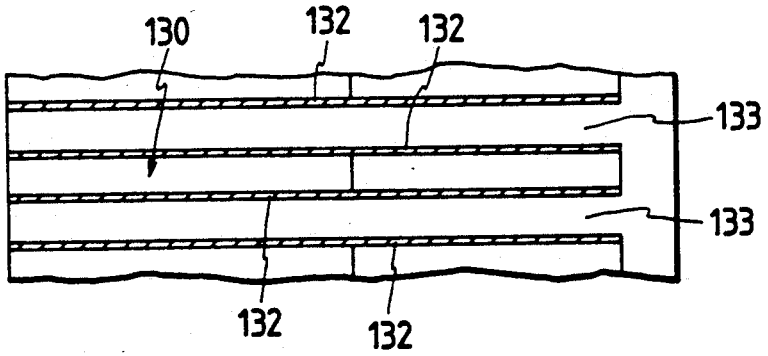
FIG. 22B is a top view of the same example as seen from the side where the grooves are open.

FIG. 22 shows the structure of another example of grooves that are to be formed in a piezoelectric substrate and that are effective for the purpose of concentrating a pressure wave. Reference numeral 130 is a groove that is formed in the surface of a piezoelectric substrate 131 and that consists of a deep region 130*a* closer to a nozzle orifice and a shallow region 130*b* closer to the ink supply port, the depth of which portion is in no way detrimental to the generation of ink drops. An electrode 132 is formed on the inner (wall and bottom) surfaces of those regions. A diaphragm 133 that separates two adjacent grooves 130 and that will deform in response to a drive signal applied to the electrode 132 is such that the height H1 of the region closer to the ink supply port is smaller than the height H2 of the region closer to the nozzle orifice and, therefore, the region closer to the ink supply port has a higher elastic modulus on account of the constraint exerted by the bottom surface. Thus, upon application of a drive signal to the electrode, the region of the diaphragm closer to the ink supply port will first deform and the region closer to the nozzle orifice which has a lower elastic modulus will subsequently deform. As a result, the diaphragm in the region closer to the nozzle orifice deforms to create a pressure wave that is superposed on the pressure wave that has propagated from the region closer to the ink supply port. Hence, a pressure wave that is as sharp as is produced in the previous embodiment will act on the nozzle orifice.

Figure 23A:
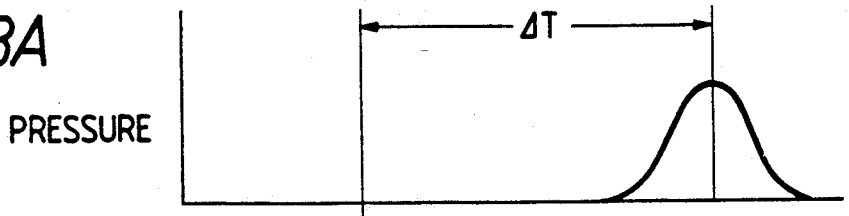
FIGS. 23A–23C shows the state of a pressure wave to be exerted upon ink when the electrode structures and grooves shown in FIGS. 18–22 are adopted, as well as the shape of an ink drop that is generated by said pressure wave.
Figure 23B:
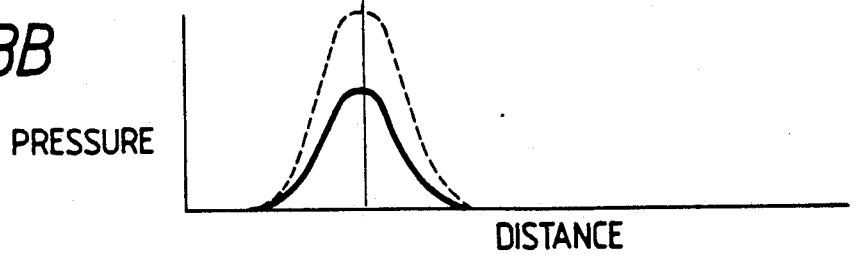
Figure 23C:
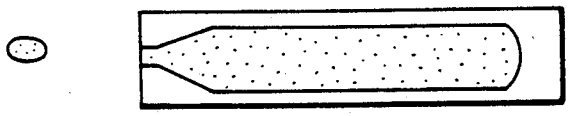

In the examples shown in FIGS. 19–22, the pressure wave that has been generated on the ink supply port side (see FIG. 23A) will reach the nozzle orifice after the lapse of time $\Delta T$ (FIG. 23B), causing the diaphragm in that region to deform. Hence, a pressure wave that has short tails and a high peak value as indicated by a dashed line in FIG. 23B can be propagated to the nozzle orifice. As a result, ink drops having a high ejection rate and a short duration will be generated and squirted onto recording paper with minimum bends and not tailings (see FIG. 23C).

Figure 24A:
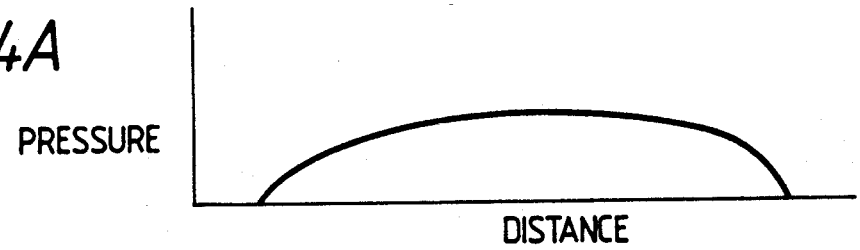
FIGS. 24A and 24B shows the state of a pressure wave to be exerted upon ink when none of the approaches shown in FIGS. 18–22 are taken, as well as the shape of inks drops that are generated by said pressure wave.
Figure 24B:
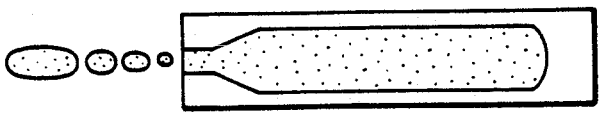

However, in the absence of the arrangements described above, pressure waves are generated simultaneously in all regions from the nozzle orifice to the ink supply port as shown in FIG. 24A and those pressure waves will successively propagate to the nozzle orifice, so that ink will be squirted over a fairly long time as in the case of the fluid from a water pistol. As a result, the generated ink drops will have a small velocity of jetting and continue for a long period (see FIG. 24B), whereby bends and satellites (undesired drops) are produced to lower the print quality.

Figure 25:
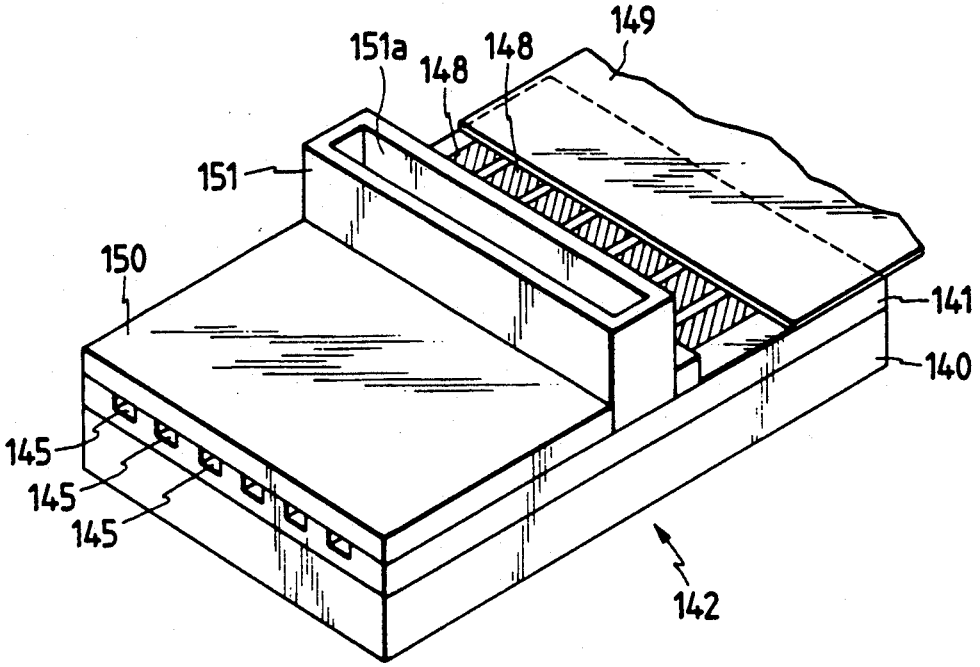
FIG. 25 is a perspective view of an ink-jet recording head according to a second embodiment of the present invention.

FIG. 25 shows a second embodiment of the present invention. Reference 140 is a substrate that is made of piezoelectric material such as lead zirconate and it has a selected thickness, e.g. 1 mm, which is greater than one half the depth, e.g. 400 μm, of the deepest portion of a fluid passageway to be described just below. The substrate 140 is preliminarily polarized in the direction of its thickness. Reference numeral 141 is an upper substrate that is made of the same material as the substrate 140 and it has a selected thickness, e.g. 200 μm, which is approximately equal to one half the depth of the deepest portion of the fluid passageway. This substrate is also polarized preliminarily in the direction of its thickness. The two substrates 140 and 141 are fixed together with an adhesive into a single substrate unit 142 in such a way that the directions of polarization are opposite to each other.

Figure 26:
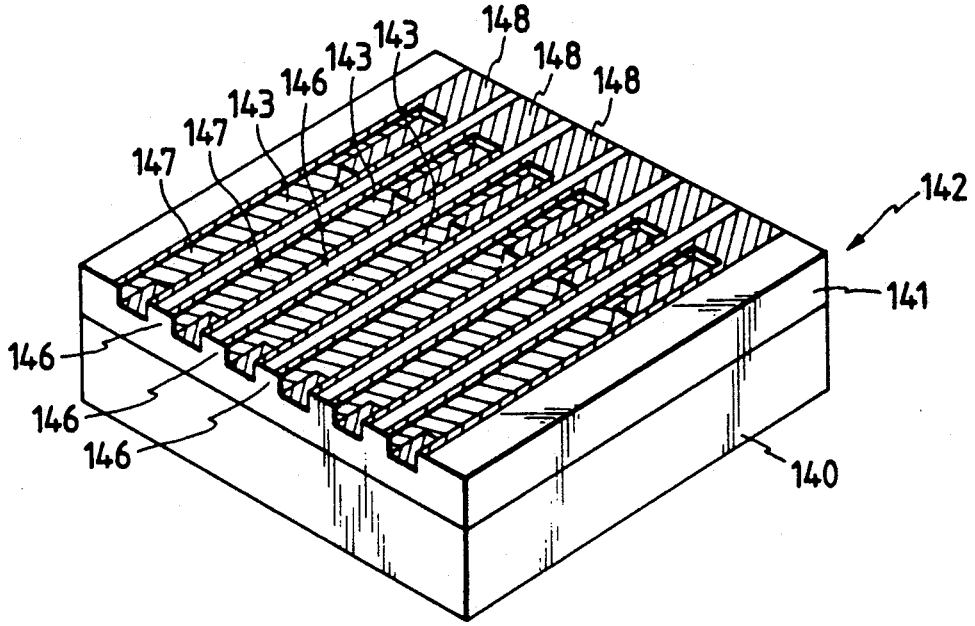
FIG. 26 is a perspective view showing the structure of the piezoelectric substrate used in the ink-jet recording head shown in FIG. 25; lo
Figure 27:
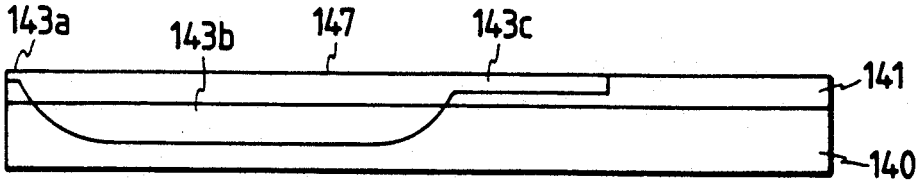
FIG. 27 is a cross-sectional view showing the shape of grooves formed in the piezoelectric substrate.

As shown in FIG. 26, the substrate unit 142 has grooves 143 formed in the surface of the less thick upper substrate 141. These grooves have a selected width of 85 μm and, as shown in FIG. 27, each groove 143 consists of the following three portions: a portion 143*a* that is formed at an end of the substrate unit 142 and that has a very small depth, e.g. 80 μm, to enable the formation of a nozzle orifices in combination with a top cover 150 that is to be described below; a portion 143*b* that has a greater depth, e.g. 400 μm, about twice the thickness of the upper substrate 141; and a portion 143*c* that is formed closer to the other end of the substrate unit 142 and that has a smaller depth, e.g. 100 μm, so that the fluid passageway is interrupted part of the way by an inner surface of the substrate 141. The depth and length of the portion 143*c* are selected in such a way that it will present a certain fluid resistance in cooperation with the inlet port 151*a* of an ink supply member 151 (to be described just below), namely, less ink will return during printing whereas the ink will flow in rapidly during ink supply.

The grooves 143 are separated by diaphragms 146 that are made of the same materials as the substrates, and their inner (wall and bottom) surfaces are coated with a metal layer to provide electrodes 147, which are connected to a cable 149 by conductive patterns 148 so as to receive a drive signal from an external drive circuit.

Turning back to FIG. 25, reference numeral 150 is a top cover which is fixed to the substrate unit 142 so as to seal the grooves 143 over the area from the front end 143*a* to the rear end 143*c*. Reference numeral 151 is an ink supply member has the inlet port 151*a* located in a position that communicates with part of the rear end 143*c* of each groove 143.

Figure 28A:
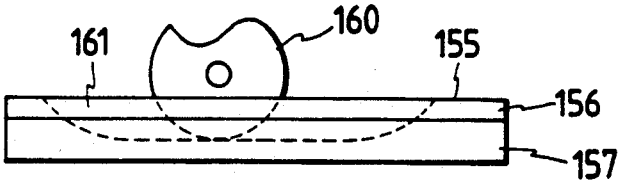
FIGS. 28A to 28C are diagrams showing a process of forming grooves in the piezoelectric substrate.
Figure 28B:
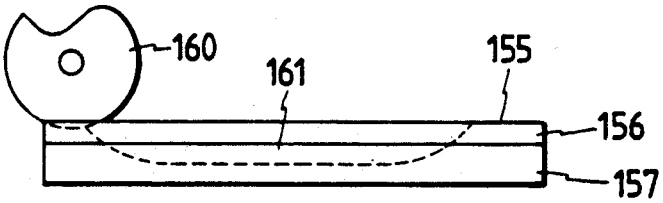
Figure 28C:
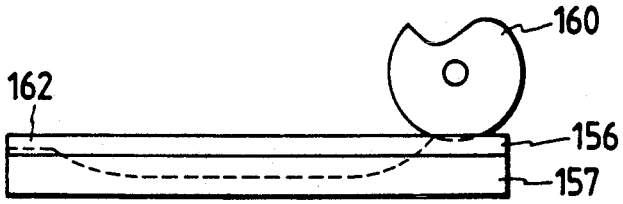

FIGS. 28A to 28C shows an illustrative method of forming grooves 143 in piezoelectric substrates. Shown by 155 is a substrate unit that is formed by bonding two preliminarily polarized piezoelectric substrates 156 and 157 in such a way that the directions of polarization are opposite to each other. The substrate unit is fixed to a work table, with the thinner substrate 156 facing up to be subjected to cutting. With the unit being thus set up, a dicing saw 160 is set in such a position that it is located in the center of a groove to be formed and cutting is effected to a depth about twice the thickness of the substrate 156 and the saw or the substrate unit 155 is moved relatively to form a groove 161 of a length suitable for an ink cavity (see FIG. 28A).

When the groove 161 that is to provide an ink cavity is thus formed, the dicing saw 160 is raised and moved to the front end of the substrate unit 155, where it is cut to a predetermined depth (see FIG. 28B). Thereafter, the dicing saw 160 is moved the other end of the substrate unit 155 and cutting is effected to form a portion that serves as a connection to the ink supply port 151*a*. In this case, the cutting depth and length are adjusted in accordance with the type of ink used and the ink supply pressure.

When the formation of a full length of grooves is finished, a layer of Ni-Cr alloy is formed in a thickness of 2 to 4 μm by a suitable technique such as evaporation, sputtering or electroless plating and this alloy layer is subsequently coated with a gold (Au) layer in a thickness of under than 1 μm. After thus forming a metal layer over the entire surface of the substrate unit including the inner and bottom surfaces of the grooves, the metal layer on top of the diaphragms which define the grooves is removed to electrically isolate the electrodes for individual grooves. Thereafter, conductive paths to be connected to those electrodes are formed by separating the metal layer on the surface of the substrate unit at its rear end in correspondence to the electrode pattern.

Figure 29:
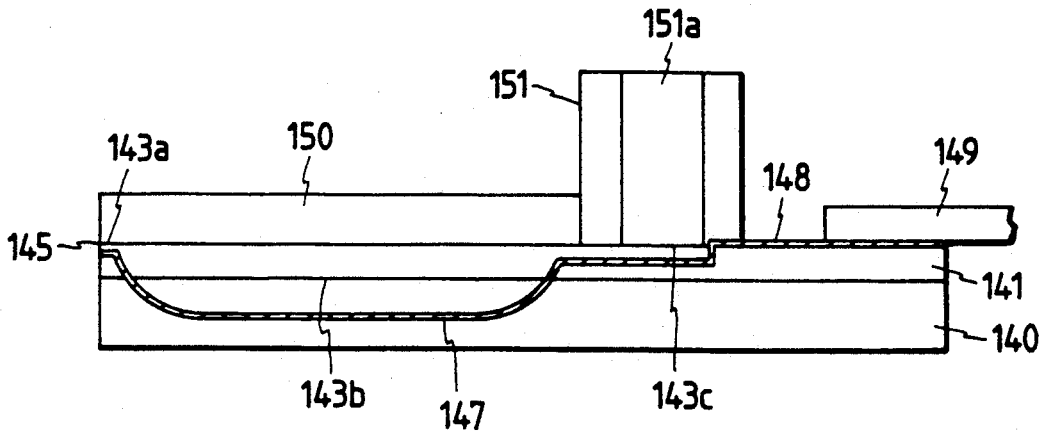
FIG. 29 is a diagram showing a sectional structure of the device shown in FIG. 25.

FIG. 29 shows a sectional structure of the ink-jet recording head that is constructed in the manner described above. When ink is supplied through the inlet port 151*a*, it will flow into the grooves 143 from the rear end 143*c* and continues flowing all the way through the grooves to form a meniscus at the nozzle orifices 145. Then, a voltage of one polarity is applied to the electrode for the groove communicating with the nozzle orifice from which ink drops should be squirted to form dots whereas a voltage of the other polarity is applied to the electrodes for two adjacent grooves. As a result, the diaphragms that define the groove of interest will deform in a shear mode towards the ink cavity so as to reduce its capacity, whereby ink drops will be squirted from the nozzle orifice 145 that is formed by the front end 143*a* of the groove in the substrate unit and the top cover 150. When the dot formation ends, the application of voltage is ceased, whereupon the diaphragms are restored to the initial state and the capacity of the groove will increase, so that additional ink is supplied from the rear end 143*c* of the groove to condition the head for the next printing run.

In the example just described above, printing is performed by first contracting the ink cavity in response to a drive signal. It should, however, be noted that as already explained with reference to FIG. 17, printing may be performed by first expanding the ink cavity and then contracting it.

The techniques shown in FIGS. 18–22 may also be applied to the example under consideration. That is, each electrode may be divided into at least two regions, one being located closer to the nozzle orifice and the other closer to the ink supply port and a drive signal is applied first to the region closer to the ink supply port, with successive drive signals being applied with a time lag that matches the propagation speed of the pressure wave; or electrodes are formed in such a way that their thickness increases stepwise in order from the nozzle orifice side to the ink supply port side; or the elastic modulus of the region closer to the nozzle orifice is made relatively small by, for example, forming grooves that are shallower in the region closer to the ink supply port. It will be apparent to one skilled in the art that by adopting those techniques, pressure waves that have short tails and high peak values can be produced to generate sharp ink drops without tailings.

Figure 30:
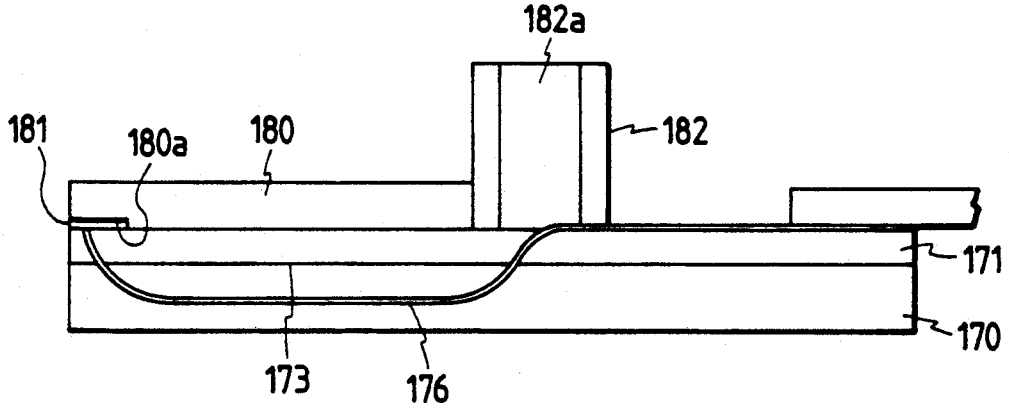
FIG. 30 is a cross-sectional view showing an ink-jet recording head according to a third embodiment of the present invention.

FIG. 30 shows a third embodiment of the present invention. Shown by 170 is a substrate that is made of a piezoelectric material such as lead zirconate and it has a selected thickness, e.g. 1 mm which is greater than one half the depth, e.g. 400 μm, of the deepest portion of a fluid passageway to be described just below. The substrate 170 is preliminarily polarized in the direction of its thickness. Shown by 171 is an upper substrate that is made of the same material as the substrate 170 and it has a selected thickness, e.g. 200 μm, which is approximately equal to one half the depth of the deepest portion of the fluid passageway. This substrate is also polarized preliminarily in the direction of its thickness. The two substrates 170 and 171 are fixed together with an adhesive into a single substrate unit in such a way that the directions of polarization are opposite to each other.

The substrates 170 and 171 have grooves 173 of a width of about 85 μm formed in such a way that they are open at the surface of the less thick upper substrate 171. The grooves 173 are spaced at a constant pitch as already described in the previous embodiments. The grooves 173 are generally boat-shaped in cross section and the depth of their central portion is about 400 μm, which is approximately twice the thickness of the substrate 171. The inner (wall and bottom) surfaces of the grooves 173 are coated with a metal layer to form electrodes 176 as in the previous embodiments.

Figure 31:
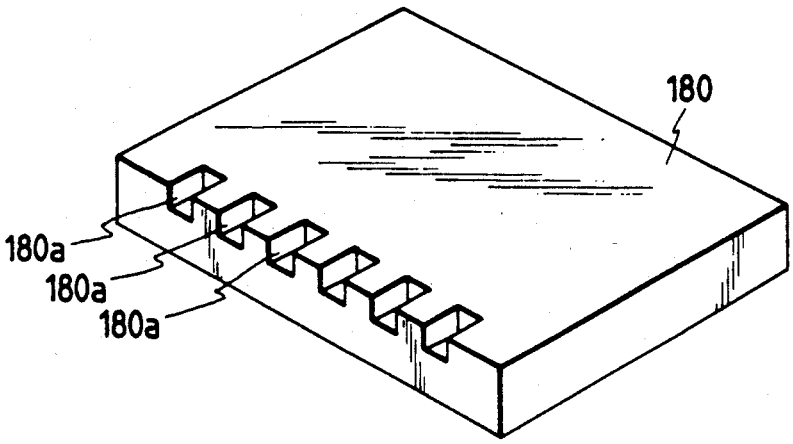
FIG. 31 is a perspective view showing an example of the top cover member used in the printing head of FIG. 30.
Figure 32:
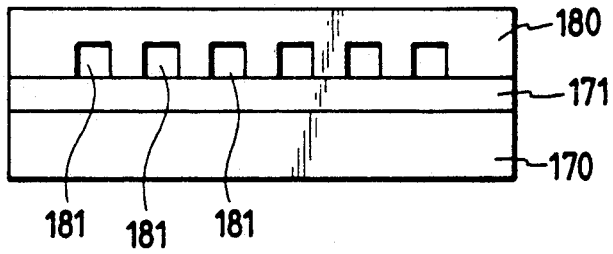
FIG. 32 is a front view showing the structure of said recording head as seen from the side where nozzle orifices are open.

Shown by 180 in FIG. 30 is a top cover which has grooves 180*a* formed therein as shown in FIG. 31; the grooves 180*a* are open at one end and have a length at least sufficient to communicate at the other end with the grooves 173 in the piezoelectric substrate 171. The depth and width of each groove 180*a* are of a selected size, such as ca. 80 μm, that is appropriate for forming a nozzle orifice from which ink drops are to be squirted. The grooves 180*a* are spaced at the same pitch as grooves 173 and they are provided in such a way that they combine with the surface of the substrate 171 to form nozzle orifices 181 (see FIG. 32). Shown by 182 in FIG. 30 is an ink supply member which is fixed to the substrate 171 in such a way that the ink supply port 182*a* communicates with the rear end of each groove 173.

In the embodiment under consideration, the electrodes 176 for two grooves that are adjacent to the groove communicating with the nozzle orifice from which ink drops should be squirted to form dots are supplied with a drive signal as in the previous embodiments. Then, the diaphragms that define the groove of interest will deform and the ink cavity contracts, whereupon the ink contained in the groove (cavity) is compressed to be squirted in drops from the nozzle orifice 181 which is defined by the groove 180*a* in the top cover 180 and the surface of the substrate 171.

In the embodiment just described above, printing is performed by first contracting the ink cavity in response to a drive signal. It should, however, be noted that s already explained with reference to FIG. 17, printing may be performed by first expanding the ink cavity and then contracting it.

The techniques shown in FIGS. 18–22 may be also be applied to the embodiment under consideration. That is, each electrode may be divided into at least two regions, one being located closer to the nozzle orifice and the other closer to the ink supply port and a drive signal is applied first to the region closer to the ink supply port, with successive drive signals being applied with a time lag that matches the propagation speed of the pressure wave; or electrodes are formed in such a way that their thickness in creases stepwise in order from the nozzle orifice side to the ink supply port side; or the elastic modulus of the region closer to the nozzle orifice is made relatively small by, for example, forming grooves that are shallower in the region closer to the ink supply port. It will be apparent to one skilled in the art that by adopting those techniques, pressure waves that have short tails and high peak values can be produced to generate sharp ink drops without tailings.

Figure 33:
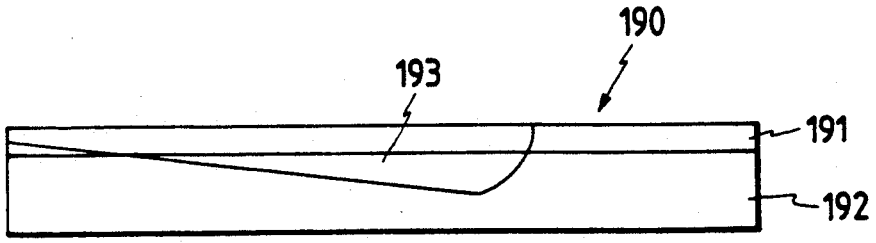
FIG. 33 is a cross-sectional view showing the structure of grooves formed in the piezoelectric substrates of an ink-jet recording head according to a fourth embodiment of the present invention.

FIG. 33 shows the structure of grooves formed in the piezoelectric substrates of an ink-jet recording head according to a fourth embodiment of the present invention. Shown by 190 is a substrate unit that is composed of two polarized piezoelectric substrates 191 and 192. The substrate 191 has a thickness approximately one half the depth of the deepest portion of the grooves to be formed and the substrate 192 is thicker than the substrate 191. The two substrates are bonded together in such a way that the directions of their polarization are opposite to each other. In those substrates, grooves are formed in such a way that their depth increases monotonically in a linear fashion from the nozzle orifice side towards the ink supply port.

According to the fourth embodiment of the present invention, a groove can be formed by a single cutting operation in which a dicing saw is placed in contact with the side of the substrate unit 190 where nozzle orifices are to be formed and then the saw is moved with the relative distance between the saw and the substrate 190 being reduced in the direction in which the groove is formed.

Figure 34:
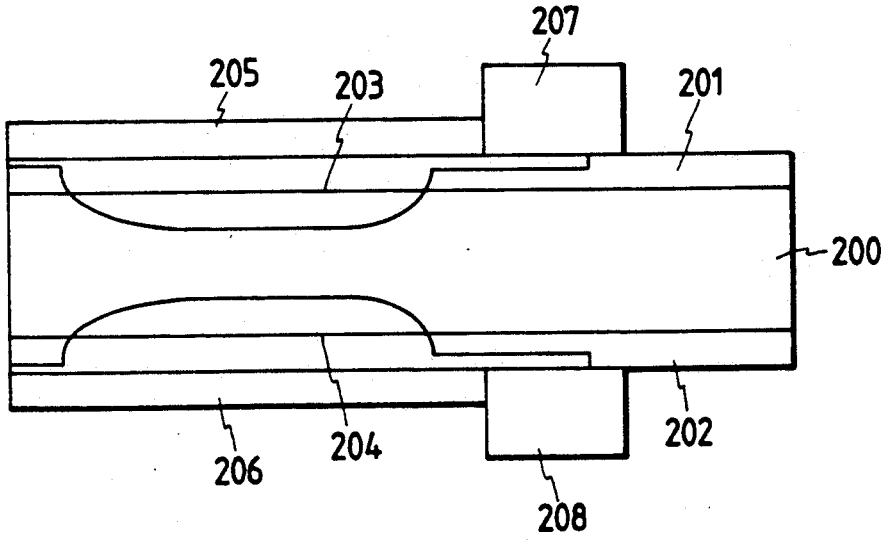
FIG. 34 is a cross-sectional view showing the relative positions of piezoelectric substrates and covers, as well as the structure of grooves formed in said piezoelectric substrates in the case where dual nozzle rows are provided in the second, third and fourth embodiments of the present invention.

The foregoing description of the third and fourth embodiments of the present invention shown in FIGS. 25 and 30 is directed to the case where nozzle orifices are formed in only one surface of a substrate unit but it should be understood that two rows of nozzle orifices may be formed as shown in FIG. 1. An example of this two-row arrangement is shown in FIG. 34. Piezoelectric substrates 201 and 202 each having a thickness about one half the depth of the grooves to be formed are bonded to the opposite surfaces of a centrally positioned piezoelectric substrate 200. Grooves 203 and 204 are then formed at a predetermined pitch in the surfaces of the substrates 201 and 202, respectively. The grooves 203 and 204 are provided with electrically isolate electrodes and subsequently sealed with covers 205 and 206, respectively. Finally, ink supply members 207 and 208 are provided on the respective substrates 201 and 202 in such a way that they communicate with the grooves 203 and 204, respectively. This provide a simple process for constructing a recording head that has two rows of nozzle orifices on opposite surfaces.

Figure 35:
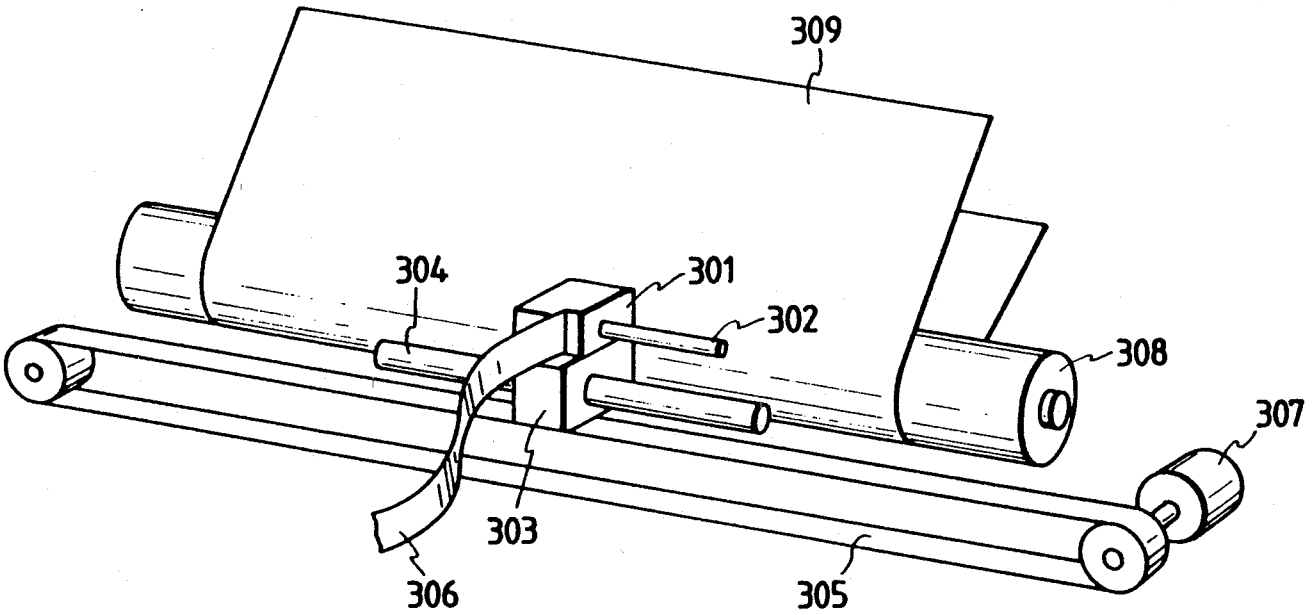
FIG. 35 shows a printer in which an ink-jet recording head according to the present invention is employed.

FIG. 35 shows a printer in which an ink-jet recording head according to the present invention is employed. In this printer, a head carriage 303 mounts an ink jet-recording head to which an ink for printing is supplied from a ink supply pipe 302 and pint data are applied through a flexible wiring substrate 306. The head carriage 303 is driven by a carriage motor 307 through a carriage belt so that the head is shuttled along a carriage guide 304 extending in a main scanning direction. Thus, a recording paper on a platen 308 is printed.

What is claimed is:

1. An ink-jet recording head comprising:

a plurality of piezoelectric substrates each polarized in a direction of thickness thereof and having a plurality of spaced grooves disposed at a predetermined pitch and being separated by diaphragm; and electrodes formed in said grooves in an electrically isolated manner, each of said grooves comprising a first portion having a sufficient depth to form an ink reservoir, a second portion communicating with one side of the head and having a sufficient depth, shallower than the depth of said first portion, to provide an orifice that is adapted to squirt ink drops, and a third portion having a depth appropriate for receiving an externally supplied ink, said piezoelectric substrates being fixed together onto a unitary assembly such that respective surfaces of the substrates in which each said orifice is provided are in registry and that the directions of polarization in said substrates are opposite to each other, said recording head further including an ink supply means provided on a side opposite to a side where said orifice is to be provided.

2. An ink-jet recording head according to claim 1 wherein each of said electrodes is divided into at least two regions in a longitudinal direction of the grooves.

3. An ink-jet recording head according to claim 1 wherein each of said electrodes is formed such that a thickness thereof is relatively thin proximate an orifice side and relatively thick proximate an ink supply side.

4. An ink-jet recording head according to claim 1 wherein said grooves are formed to be shallow in a region closer to the ink supply side so that the diaphragms in region closer to an orifice side will have a smaller elastic modulus.

5. An ink-jet recording head comprising:

a central substrate that is polarized in a direction of thickness thereof and that has, on opposite surfaces, grooves spaced by diaphragms at a predetermined pitch and electrodes that are formed in said grooves in an electrically isolated manner, each of said grooves comprising a portion having a sufficient depth to form an ink reservoir, a portion communicating with one side of the head and having a sufficient depth to provide an orifice that is adapted to squirt ink drops, and a portion having a depth appropriate for receiving externally supplied ink;

two piezoelectric substrates each polarized in a direction of thickness thereof, one surface of each of said piezoelectric substrates having a plurality of spaced grooves disposed at a predetermined pitch and being separated by diaphragms and electrodes formed in each of said grooves in an electrically isolated manner, each of said grooves comprising a portion having a sufficient depth to form an ink reservoir, a portion communicating with one side of the head and having a sufficient depth to provide an orifice that is adapted to squirt ink drops, and a portion having a depth appropriate for receiving an externally supplied ink;

said two piezoelectric substrates being fixed to said central substrate to form a unitary assembly such that respective surfaces of said two piezoelectric substrates in which each said orifice is provided are aligned with a surface in which each said orifice of the central substrate is provided and that respective directions of polarization in said two substrates are opposite to a direction of polarization in the central substrate, said recording head further including an ink supply means provided on a side opposite to a side where said orifice is to be provided.

6. An ink-jet recording head according to claim 5 wherein each of said electrodes is divided into at least two regions in a longitudinal direction of the grooves.

7. An ink-jet recording head according to claim 5 wherein each of said electrodes is formed such that a thickness thereof is relatively thin proximate an orifice side and relatively thick proximate the ink supply side.

8. An ink-jet recording head according to claim 5 wherein said grooves are formed to be shallow in a region closer to the ink supply side so that the diaphragms in a region closer to an orifice side will have a smaller elastic modulus.

9. An ink-jet recording head according to claim 5 wherein the grooves formed in one surface of said central substrate are offset from the grooves in another opposite surface by one half of the pitch between adjacent grooves.

10. An ink-jet recording head, comprising:

a substrate unit including a first and a second polarized piezoelectric substrate that are bonded together and polarized in directions opposite to each other, said substrate unit having a plurality of grooves formed therein that are spaced by diaphragms at a predetermined pitch and electrodes that are formed in said grooves in an electrically isolated manner, each of said grooves comprising a first portion that extends from the surface of the first piezoelectric substrate to a partial thickness of the second piezoelectric substrate and that has a sufficient depth to form an ink reservoir, a second portion communicating with one side of the first piezoelectric substrate and having a sufficient depth to provide an orifice that is adapted to squirt ink drops, and a third portion having a depth appropriate for receiving externally supplied ink;

a top cover that seals a surface of said substrate unit where the grooves are open; and a member for supplying ink into said grooves.

11. An ink-jet recording head according to claim 10 wherein said first piezoelectric substrate has a thickness approximately one half the depth of the ink reservoir portion.

12. An ink-jet recording head according to claim 10 wherein each of said electrodes is divided into at least two regions in a longitudinal direction of the grooves.

13. An ink-jet recording head according to claim 10 wherein each of said electrodes is formed such that a thickness thereof is relatively thin proximate an orifice side and relatively thick proximate an ink supply side.

14. An ink-jet recording head according to claim 10 wherein said grooves are formed to be shallow in a region closer to an ink supply side so that the diaphragms in a region closer to an orifice side will have a smaller elastic modulus.

15. An ink-jet recording head comprising:

a substrate unit including a first, a second and a third polarized piezoelectric substrate that are bonded together with said second substrate being disposed between said first and said third substrate and are polarized in opposite directions, said substrate unit having a plurality of grooves formed therein that are spaced by diaphragms at a predetermined pitch and electrodes that are formed in said grooves in an electrically isolated manner, each of said grooves comprising a portion that extends from a surface of the first and third piezoelectric substrate to a partial thickness of the second piezoelectric substrate and that has a sufficient depth to form an ink reservoir, a portion communicating with one side of the first piezoelectric substrate and having a sufficient depth to provide an orifice that is adapted to squirt ink drops, and a portion having a depth appropriate for receiving an externally supplied ink;

two covers that seal opposite surfaces of said substrate unit where the grooves are open; and a member for supplying ink into said grooves.

16. An ink-jet recording head according to claim 15 wherein said first and said third piezoelectric substrate have a thickness approximately one half the depth of the ink reservoir portion.

17. An ink-jet recording head according to claim 15 wherein each of said electrodes is divided into at least two regions in a longitudinal direction of the grooves.

18. An ink-jet recording head according to claim 15 wherein each of said electrodes is formed such that a thickness thereof is relatively thin proximate an orifice side and relatively thick proximate the ink supply side.

19. An ink-jet recording head according to claim 15 wherein said grooves are formed to be shallow in a region closer to a ink supply side so that the diaphragms in a region closer to an orifice side will have a smaller elastic modulus.

20. An ink-jet recording head according to claim 15 wherein the grooves formed in one surface of said second substrate are offset from the grooves in another opposite surface by one half of the pitch between adjacent grooves.

21. An ink-jet recording head, comprising:

a substrate unit including a first and a second polarized piezoelectric substrate that are bonded together and are polarized in opposite directions, said substrate unit having a plurality of grooves formed therein that are spaced by diaphragms at a predetermined pitch and electrodes that are formed in said grooves in an electrically isolated manner, each of said grooves extending from a surface of the first piezoelectric substrate to a partial thickness of the second piezoelectric substrate and having a sufficient depth to form an ink reservoir, said grooves being sealed at both ends;

a top cover fixed to a surface of the first substrate and having a plurality of grooves respectively communicating with the grooves in said substrate unit to form nozzle orifices at one end of said grooves; and a member for supplying ink into said grooves at a position upstream of said one end.

22. An ink-jet recording head according to claim 21 wherein said first piezoelectric substrate has a thickness approximately one half the depth of the ink reservoir portion.

23. An ink-jet recording head according to claim 21 wherein each of said electrodes is divided into at least two regions in a longitudinal direction of the grooves.

24. An ink-jet recording head according to claim 21 wherein a thickness of each of said electrodes increases from said one end of said grooves to said upstream position where said ink is supplied.

25. An ink-jet recording head according to claim 21 wherein said grooves are formed to be shallow in a region closer to an ink supply side so that the diaphragms in a region closer to an orifice side will have a smaller elastic modulus.

26. An ink-jet recording head comprising:

a substrate unit including a first, a second and a third polarized piezoelectric substrate that are bonded together with said second substrate being disposed between said first and said third substrate and polarized in opposite directions, said substrate unit having a plurality of grooves formed therein that are spaced by diaphragms at a predetermined pitch and electrodes that are formed in said grooves in an electrically isolated manner, each of said grooves extending from a surface of the first and third piezoelectric substrate to a partial thickness of the second piezoelectric substrate and having a sufficient depth to form an ink reservoir, said grooves being sealed at both ends;

two covers fixed to said surfaces of said first and said third substrate and having a plurality of grooves respectively communicating with the grooves in said substrate unit to form nozzle orifices at one end of said grooves; and a member for supplying ink into said grooves at a position upstream of said one end.

27. An ink-jet recording head according to claim 26 wherein said first and said third piezoelectric substrate have a thickness approximately one half the depth of the ink reservoir portion.

28. An ink-jet recording head according to claim 26 wherein each of said electrodes is divided into at least two regions in a longitudinal direction of the grooves.

29. An ink-jet recording head according to claim 26 wherein a thickness of each of said electrodes increases from the said one end of said grooves to said upstream position where said ink is supplied.

30. An ink-jet recording head according to claim 26 wherein said grooves are formed to be shallow in a region closer to an ink supply side so that the diaphragms in a region closer to an orifice side will have a smaller elastic modulus.

31. A printing apparatus comprising an ink-jet recording head, a head carriage for mounting said ink-jet recording head, head carriage driving means for driving said head carriage in a scanning direction, and a platen on which a recording paper is disposed, said ink-jet recording head comprising:

a plurality of piezoelectric substrates each polarized in a direction of thickness thereof and having a plurality of spaced grooves disposed at a predetermined pitch and being separated by diaphragms; and electrodes formed in said grooves in an electrically isolated manner, each of said grooves comprising a first portion having a sufficient depth to form an ink reservoir, a second portion communicating with one side of the head and having a sufficient depth, shallower than the depth of said first portion, to provide an orifice that is adapted to squirt ink drops, and a third portion having a depth appropriate for receiving externally supplied ink, said piezoelectric substrates being fixed together onto a unitary assembly such that respective surfaces of the substrates in which each said orifice is provided are in registry and that the directions of polarization in said substrates are opposite to each other, said recording head further including an ink supply means provided on a side opposite to a side where said orifice is to be provided.

32. A printing apparatus comprising an ink-jet recording head, a head carriage for mounting said ink-jet recording head, head carriage driving means for driving said head carriage in a scanning direction, and a platen on which a recording paper is disposed, said ink-jet recording head comprising:

a central substrate that is polarized in a direction of thickness thereof and that has, on opposite surfaces, grooves spaced by diaphragms at a predetermined pitch and electrodes that are formed in said grooves in an electrically isolated manner, each of said grooves comprising a portion having a sufficient depth to form an ink reservoir, a portion communicating with one side of the head and having a sufficient depth to provide an orifice that is adapted to squirt ink drops, and a portion having a depth appropriate for receiving an externally supplied ink;

two piezoelectric substrates each polarized in a direction of their thickness and each of which has, on one surface, grooves spaced by diaphragms at a predetermined pitch and electrodes that are formed in said grooves in an electrically isolated manner, each of said grooves comprising a portion having a sufficient depth to form an ink reservoir, a portion communicating with one side of the head and having a sufficient depth to provide an orifice that is adapted to squirt ink drops, and a portion having a depth appropriate for receiving an externally supplied ink;

said two piezoelectric substrates being fixed to said central substrate to form a unitary assembly where said one surface of said two piezoelectric substrates are respectively aligned with said opposite surfaces of the central substrate and that the directions of polarization in said two substrates are opposite to the direction of polarization in the central substrate, said recording head further including an ink supply means provided on a side opposite to a side where said orifice is to be provided.

33. A printing apparatus comprising an ink-jet recording head, a head carriage for mounting said ink-jet recording head, head carriage driving means for driving said head carriage in a scanning direction, and a platen on which a recording paper is disposed, said ink-jet recording head comprising:

a substrate unit including a first and a second polarized piezoelectric substrate that are bonded together and are polarized in directions opposite to each other, said substrate unit having a plurality of grooves formed therein that are spaced by diaphragms at a predetermined pitch and electrodes that are formed in said grooves in an electrically isolated manner, each of said grooves comprising a first portion that extends from a surface of the first piezoelectric substrate to a partial thickness of the second piezoelectric substrate and that has a sufficient depth to form an ink reservoir, a second portion communicating with one side of the first piezoelectric substrate and having a sufficient depth to provide an orifice that is adapted to squirt ink drops, and a portion having a depth appropriate for receiving externally supplied ink;

a top cover that seals a surface of said substrate unit where the grooves are open; and a member for supplying ink into said grooves.

34. A printing apparatus comprising an ink-jet recording head, a head carriage for mounting said ink-jet recording head, head carriage driving means for driving said head carriage in a scanning direction, and a platen on which a recording paper is disposed, said ink-jet recording head comprising:

a substrate unit including a first, a second and a third polarized piezoelectric substrate that are bonded together with said second substrate disposed between said first and third substrate and polarized in opposite directions, said substrate unit having a plurality of grooves formed therein that are spaced by diaphragms at a predetermined pitch and electrodes that are formed in said grooves in an electrically isolated manner, each of said grooves comprising a portion that extends from a surface of the first and third piezoelectric substrate to a partial thickness of the second piezoelectric substrate and that has a sufficient depth to form an ink reservoir, a portion communicating with one side of the first piezoelectric substrate and having a sufficient depth to provide an orifice that is adapted to squirt ink drops, and a portion having a depth appropriate for receiving an externally supplied ink;

two covers that seal opposite surfaces of said substrate unit where the grooves are open; and a member for supplying ink into said grooves.

35. A printing apparatus comprising an ink-jet recording head, a head carriage for mounting said ink-jet recording head, head carriage driving means for driving said head carriage in a scanning direction, and a platen on which a recording paper is disposed, said ink-jet recording head comprising:

a substrate unit including a first and a second polarized piezoelectric substrate that are bonded together and are polarized in opposite directions, said substrate unit having a plurality of grooves formed therein that are spaced by diaphragms at a predetermined pitch and electrodes that are formed in said grooves in an electrically isolated manner, each of said grooves extending from a surface of the first piezoelectric substrate to a partial thickness of the second piezoelectric substrate and having a sufficient depth to form an ink reservoir, said grooves being sealed at both ends;

a top cover fixed to a surface of the first substrate and having a plurality of grooves respectively communicating with the grooves in said substrate unit to form nozzle orifices at one end of said grooves; and a member for supplying ink into said grooves at a position upstream of said one end.

36. A printing apparatus comprising an ink-jet recording head, head carriage for mounting said ink-jet recording head, head carriage driving means for driving said head carriage in a scanning direction, and a platen on which a recording paper is disposed, said ink-jet recording head comprising:

a substrate unit that is composed of a first, a second and a third polarized piezoelectric substrate that are bonded together with said second substrate being disposed between said first and said third substrate and are polarized in opposite directions, said substrate unit having a plurality of grooves formed therein that are spaced by diaphragms at a predetermined pitch and electrodes that are formed in said grooves in an electrically isolated manner, each of said grooves extending from a surface of the first and third piezoelectric substrate to a partial thickness of the second piezoelectric substrate and having a sufficient depth to form an ink reservoir, said grooves being sealed at both ends;

two covers fixed to said surfaces of said first and said third substrate and having a plurality of grooves communicating with the grooves in said substrate unit to form nozzle orifices at one end of said grooves; and a member for supplying ink into said grooves at a position upstream of said one end.

* * * * *